US005997205A

United States Patent [19]

Koide

[11] Patent Number: 5,997,205

[45] Date of Patent: Dec. 7, 1999

[54] COATING ROLLER AND COATING APPARATUS

[76] Inventor: Takanori Koide, 9-14, Higashi-Kashiwagaya 5-chome, Ebina-shi, Kanagawa, Japan

[21] Appl. No.: 09/047,435

[22] Filed: Mar. 25, 1998

[30] Foreign Application Priority Data

Mar. 26, 1997 [JP] Japan ..... 9-073823
Sep. 18, 1997 [JP] Japan ..... 9-253921

[51] Int. Cl.[6] ..... B03C 1/10

[52] U.S. Cl. ..... 401/147; 15/230.11; 401/197; 401/204; 401/205; 401/220; 403/349

[58] Field of Search ..... 401/197, 188 R, 401/187, 146, 147, 204, 203, 205, 220, 219, 208, 290; 141/367; 15/230.11; 239/587.1, 600; 403/109.3, 116, 327, 349, 348, 325; 285/360, 361, 376, 396, 401, 402

[56] References Cited

U.S. PATENT DOCUMENTS

| | | | |
|---|---|---|---|
| 894,833 | 8/1908 | Isham | 403/349 X |
| 1,051,805 | 1/1913 | Danberg | 285/376 |
| 2,111,740 | 3/1938 | Ruane | 285/376 X |
| 2,478,318 | 8/1949 | Raub, Jr. | 401/204 X |
| 3,320,630 | 5/1967 | Furlong | 401/147 |
| 3,549,267 | 12/1970 | Wurzer et al. | 401/197 X |
| 3,620,633 | 11/1971 | Charvoz | 401/147 |
| 4,583,876 | 4/1986 | Karliner et al. | 401/197 |
| 4,735,522 | 4/1988 | Myun-Sik | 401/197 |

FOREIGN PATENT DOCUMENTS

| | | | |
|---|---|---|---|
| 676374 | 2/1930 | France | 403/349 |
| 2693387 | 1/1994 | France | 15/230.11 |
| WO 95/23033 | 8/1995 | WIPO | 401/188 R |

*Primary Examiner*—Henry J. Recla
*Assistant Examiner*—Kathleen J. Prunner
*Attorney, Agent, or Firm*—McDermott, Will & Emery

[57] ABSTRACT

In order to supply a coating to a roller, a coating supplying groove is provided along only one side of a core which is connected to an end of a support so as to act as a shaft of a roller. A coating reservoir between the roller and the core is located to one side of the core. To permit engagement and disengagement between the support and the core, an elastic member is mounted within a coating flowing hole of the core, while an inserting groove and a stopping groove are provided in the inner peripheral surface of the coating flowing hole of the core. To automatically stop and start the supply of coating to the coating roller, and to adjust the flow rate, the number of revolutions of the roller are detected and used to actuate the coating feed mechanism to supply coating at a flow rate corresponding to the number of revolutions and or direction of rotation of the roller.

7 Claims, 23 Drawing Sheets

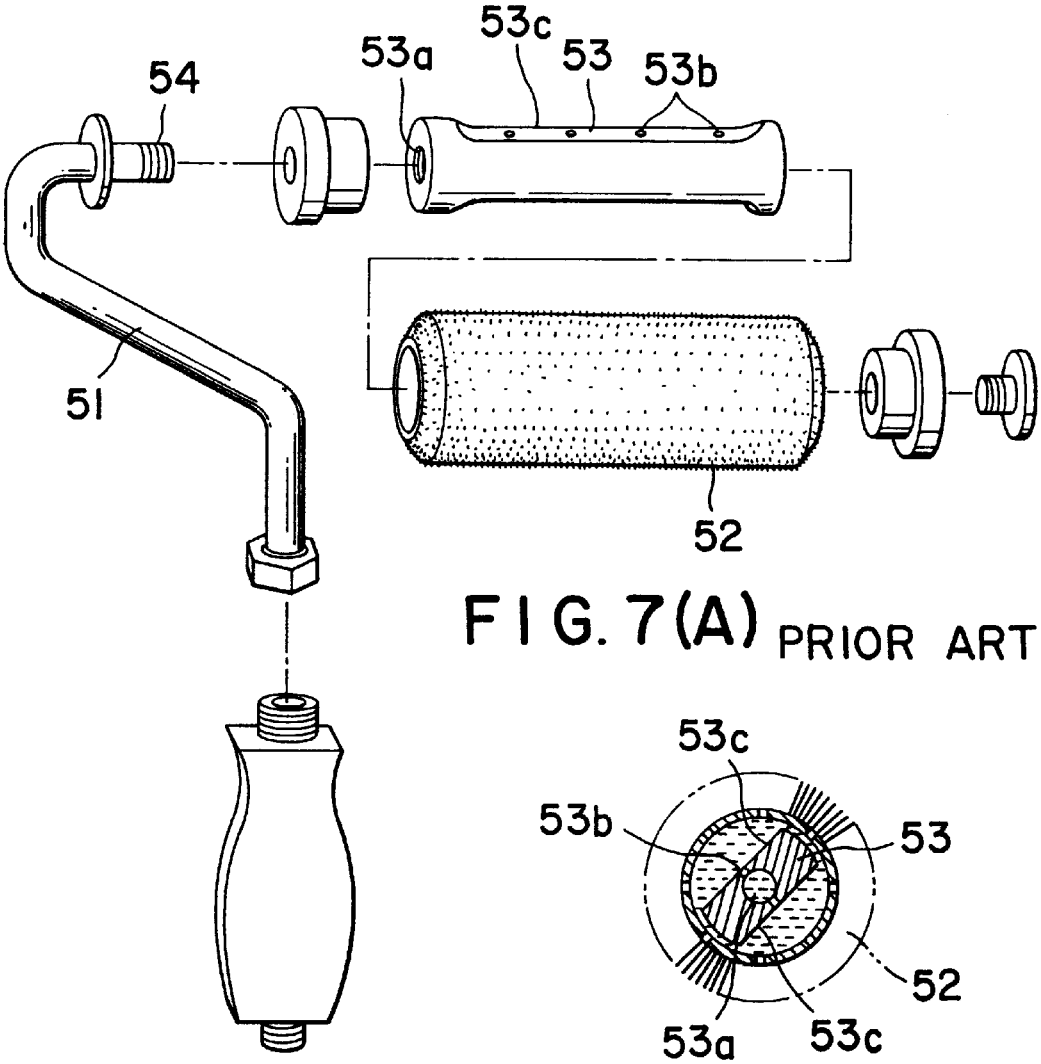
FIG. 7(A) PRIOR ART
FIG. 7(B) PRIOR ART
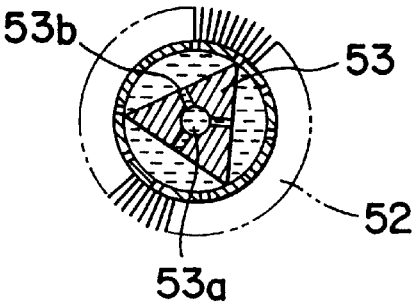
FIG. 8 PRIOR ART

COATING ROLLER AND COATING APPARATUS

BACKGROUND OF THE INVENTION

1. Field of the Invention

The present invention relates to a coating roller used for coating wall surfaces or the like, and an apparatus for supplying a coating material to the coating roller.

2. Description of the Prior Art

In a known arrangement, a coating roller has a core fixed to an extreme end of a support, and a roller mounted rotatably about the core.

An example of this type of conventional coating roller is shown in FIGS. 7(A) and 7(B). In this arrangement a coating supplying hole 53*a* is provided in a shaft-center direction of a core 53, small holes 53*b*, 53*b*, . . . are provided at suitable intervals in a diametrical direction of the core 53, and notch-like recesses 53*c*, 53*c*, are formed along a shaft-center direction on both sides in the diametrical direction of an outer peripheral surface of the core. As a further conventional coating roller, there is the arrangement shown in FIG. 8, wherein a core 53 is formed to have a triangular-shaped section. However with this type of arrangement a large quantity of coating stays between the core 53 and the roller 52.

Further, the support 51 and the core 53 are often connected, as shown in FIG. 7(A), via threads which are formed at an extreme (or terminal) end 54 of the support 51, and in a coating supplying hole 53*a* of the core 53.

However, in the arrangement wherein the core 53 is formed so that a large quantity of coating stays between the core 53 and the roller 52, as mentioned above, the coating either drips or is unevenly applied due to temperature or coating supply pressure.

Further, in the above-described arrangement wherein the support 51 and the core 53 are connected threadedly, the core 53 to which coating is adhered is so slippery that the core 53 is difficult to be mounted and removed and in addition, the threading is sometimes loosened during use. If the core is firmly tightened so as not to be loosened, disengaging operation of the core 53 is very difficult.

Furthermore, there is a problem in that, inasmuch as the two components are connected by threading, the coating supplying hole 53*a* is changed in direction depending on the strength of the threading, and it is difficult to maintain a quantity of coating to be coated constant.

On the other hand, the coating apparatus generally often used is provided with a coating supplying apparatus comprising a coating tank and a coating feed mechanism, in which a coating in the coating tank is supplied to the coating roller by the coating feed mechanism through a hose. In this coating apparatus, the coating supplying apparatus is put on the ground, the floor surface and the like or is shouldered using a belt, and coating operation is carried out while holding the coating roller.

A switch for supplying and stopping a coating to the coating roller is mounted on the coating supplying apparatus or the holder of the coating roller; and a coating-supply adjusting dial for adjusting the flow rate of coating is mounted on the coating supplying apparatus. These switch and dial are operated according to the operating situation to suitably adjust the flow rate of coating supplied to the coating roller.

However, in the above-described conventional coating apparatus, the switch or the coating-supply adjusting dial has to be operated every time according to the operating situation, the operation is cumbersome, and it is difficult to adjust the flow rate of coating.

Particularly, when high places are coated, an adding handle is connected to the coating roller. However, in this state, the switch mounted on the holder cannot be operated. Further, since the coating is kept to supply to the coating roller till the adding handle is lowered and the switch is operated, the coating overflows from the coating roller to waste the coating.

Further, when the operation is carried out at high places, in the type in which the coating supplying apparatus is put on the ground, the floor surface or the like, the operation of the coating-supply adjusting dial is actually impossible, and the coating drips or uneven coating occurs on the coating surface. In the type in which the coating supplying apparatus is shouldered using a belt, it is necessary to use one hand for operating the coating-supply adjusting dial and shift eyes, sometimes getting clothes dirty with the coating.

Further, since the wall surfaces or the like cannot be coated once without uneven coating, the same place should be coated a few times. In such a case, normally, the coating need not be supplied to the coating roller. So, the switch is turned off once. Since such an operation for smoothing the coating is often carried out, the operation of the switch has to be also often carried out, which is very cumbersome.

SUMMARY OF THE INVENTION

It is a first object of the present invention to provide a coating roller capable of supplying a necessary and sufficient quantity of coating to a roller.

For achieving the aforementioned object, the first coating roller according to the present invention is a coating roller comprising: a support, a roller, and a core connected and fixed to an extreme end of the support to constitute a shaft of the roller, characterized in that in the core, a coating supplying groove along a shaft-center (axial) direction is provided only at one side part in a peripheral direction of an outer peripheral portion, a coating flowing hole is provided in the shaft-center (axial) direction in a proximal surface of the core, a connecting and fixing portion is formed at a proximal portion within the coating flowing hole, and a coating outflow port communicated with the coating supplying groove is provided in a middle portion or an extreme end of the coating flowing hole.

The coating supplying groove is provided only at one side part in a peripheral direction of an outer peripheral portion of the core, whereby only a necessary and sufficient quantity of coating stays between the roller and the core, thus enabling prevention of a drip of coating, uneven coating, etc.

It is a second object of the present invention to provide a coating roller in which mounting and removing operation of the support and the core can be done easily, they are not loosened during use, and the direction of the core can be always fixed, in addition to the above-described effect.

The second roller according to the present invention in more preferable form for achieving the aforementioned first and second objects is a coating roller comprising: a support formed with a stopping projection on a roller supporting portion, a roller, a core connected and fixed to an extreme end of the support to constitute a shaft of the roller, and an elastic member mounted within a coating flowing hole of the core, characterized in that in the core, a coating supplying groove in a shaft-center direction is provided only at one side part in a peripheral direction of an outer peripheral portion, a coating flowing hole is provided in the shaft-center direction from a proximal surface of the core, an inserting groove capable of engaging and guiding the stopping projection is provided in a proximal portion of an inner peripheral surface of the coating flowing hole and a stopping groove is provided in the inner end of the inserting groove, and a coating outflow port communicated with the groove is provided in the middle portion or extreme end of the coating flowing hole, wherein in the state in which the stopping projection of the support arrives at the stopping groove through the inserting groove, the stopping projection is elastically engaged with the stopping groove by repulsion of the elastic member.

According to the coating roller constructed as described above, the extreme end of the support is inserted into the coating flowing hole of the core, and the stopping projection is allowed merely to arrive at the stopping groove through the inserting groove whereby the stopping projection is engaged with the stopping groove by repulsion of the elastic member, and the core can be easily connected and fixed to the extreme end of the support. Further, the core can be disengaged from the support merely by turning the core in the direction for releasing the elastic engagement and the core can be detachably mounted very easily, in addition to the operation and effect of the aforementioned first roller. Moreover, since the s topping groove and the stopping projection are elastically engaged by repulsion of the elastic member as described above, the connection and fixing are not loosened during use.

Further, since the direction of the core can be fixed, a quantity of coating to be coated can be maintained constant.

It is a third object of the present invention to provide a coating apparatus in which a supply and stop of coating to the coating roller, and adjustment of flow rate can be carried out automatically without operating a switch, and a coating-supply adjusting dial every time whereby cumbersome operation is omitted, waste of coating is prevented, and danger in operation can be avoided.

For achieving the aforementioned object, a coating apparatus according to the present invention comprises a coating roller for rotatably supporting a roller on one end of a support and fixing a holder on the other end, a coating supplying apparatus having a coating feed mechanism for discharging a coating from a coating tank and having a control apparatus for controlling operation of the coating feed mechanism, and a hose for connecting the coating roller and the coating supplying apparatus, characterized in that the number of revolutions of the roller is detected, the coating feed mechanism is actuated corresponding to the number of the revolutions, and a coating in flow rate corresponding to the number of the revolutions is supplied to the roller.

More preferably, this is a coating apparatus in combination of the construction of the coating apparatus and the construction of the first coating roller or the second coating roller. Such a coating apparatus can simultaneously achieve the first, and second objects, or the first to third objects.

BRIEF DESCRIPTION OF THE DRAWINGS

FIGS. 7(A) and (B) are respectively views showing one example of a conventional coating roller, FIG. 7(A) being an exploded perspective view, FIG. 7(B) being a sectional view.

FIG. 8 is a sectional view showing a further coating roller different from that of FIG. 7.

DESCRIPTION OF THE PREFERRED EMBODIMENTS

First, as a first embodiment of the present invention, a preferred embodiment of a coating roller will be described hereinafter.

Figure 1:
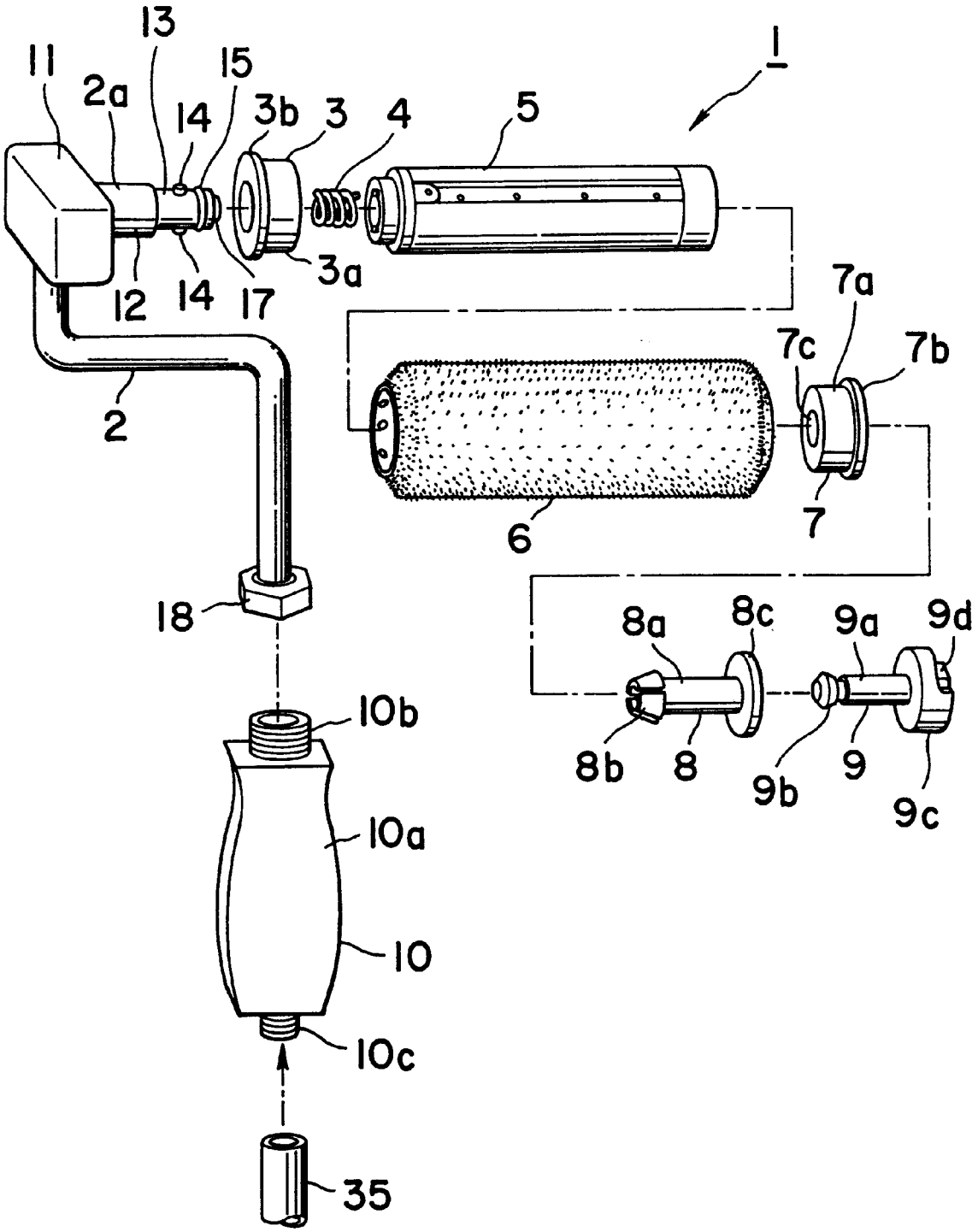
FIG. 1 is a perspective view of the state in which a coating roller according to a first embodiment is exploded.

As shown in FIG. 1, a coating roller 1 comprises a support 2, a spring 4 as an elastic member, a core 5, a roller 6, and a holder 10. The core 5 is supported by a cap 3 on the proximal side, a cap 7 on the extreme end side, and mounting member 8, 9, and is rotatably mounted on the extreme end of the support 2.

The support 2 is formed by bending an intermediate portion of a tubular member of which inside constitutes a flow passage, and comprises a support shaft 2*a* and a support lever. As shown in FIGS. 1 and 2, a cap stopping portion 11 is provided at a proximal end of the support shaft 2*a*, a cap shaft 12 is formed on the extreme end side of the cap stopping portion 11, a small diameter portion 13 is formed on the extreme or distal end of the cap shaft 12, stopping projections 14, 14 are formed at an intermediate part of the small diameter portion 13, an O-ring 15 is mounted in the vicinity of the extreme end of the small diameter portion 13, and the extreme end of the small diameter portion 13, that is, the distal end of the roller support portion 2*a* is made to have a smaller diameter to form a spring stopping portion 16 and a spring inserting portion 17. On the other hand, the support lever is formed in the proximal end with a stopping portion not shown, and a connecting member 18 is mounted while being engaged with the stopping portion.

As shown in FIG. 1, the cap 3 on the proximal side is that an annular stopping portion 3*b* is formed on the proximal side of the roller support portion 3*a* formed with an inserting hole which is slightly larger in diameter than that of the cap shaft portion 12. This is rotatably mounted on the cap shaft 12.

Figure 3:
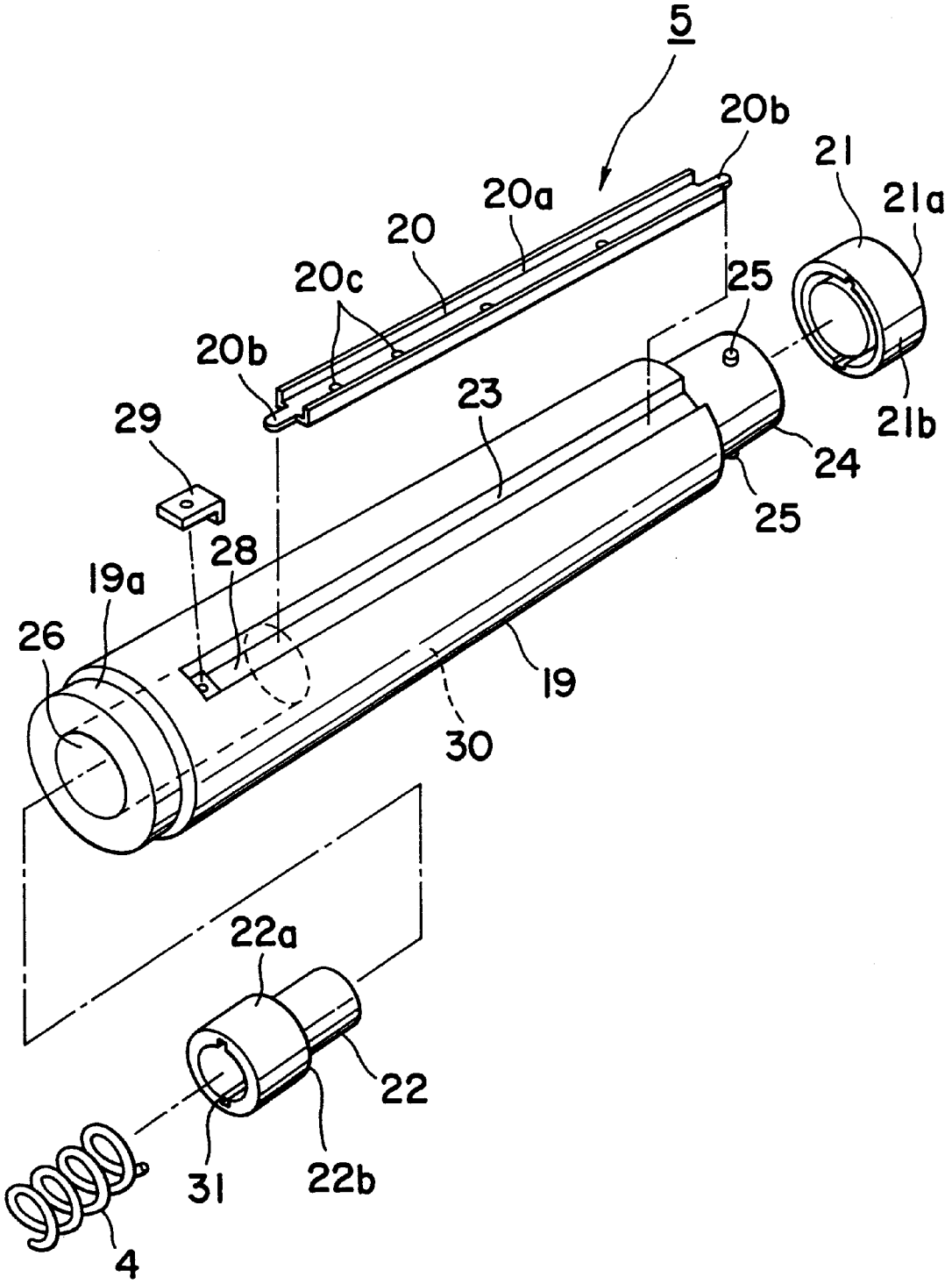
FIG. 3 is a perspective view of the state in which a core is exploded.

The core 5 comprises a core body 19, an adjusting plate 20, a closing body 21, and a fitting 22 as shown in FIG. 3.

Figure 4:
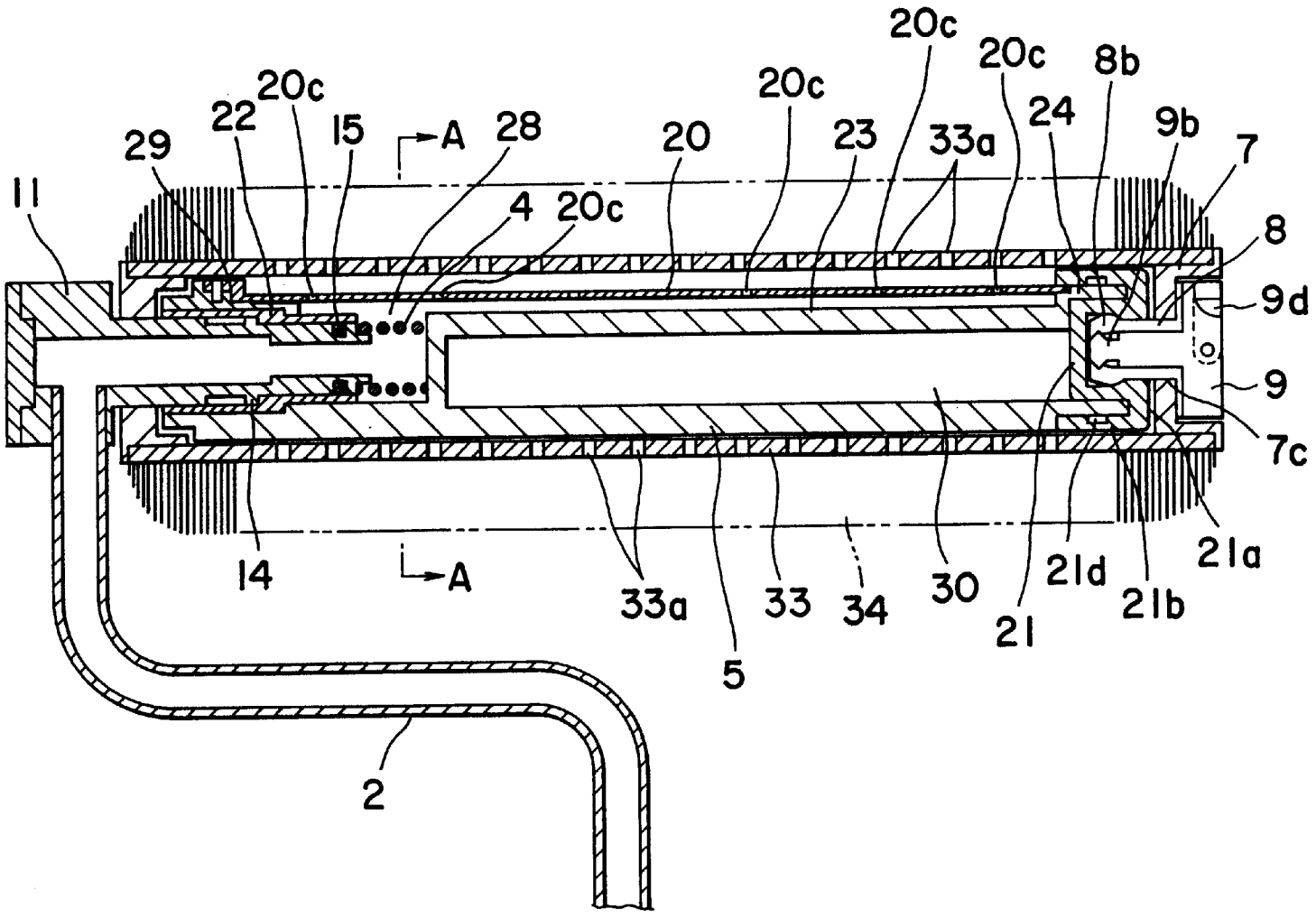
FIG. 4 is a sectional view of the coating roller shown in FIG. 1.
Figure 5:
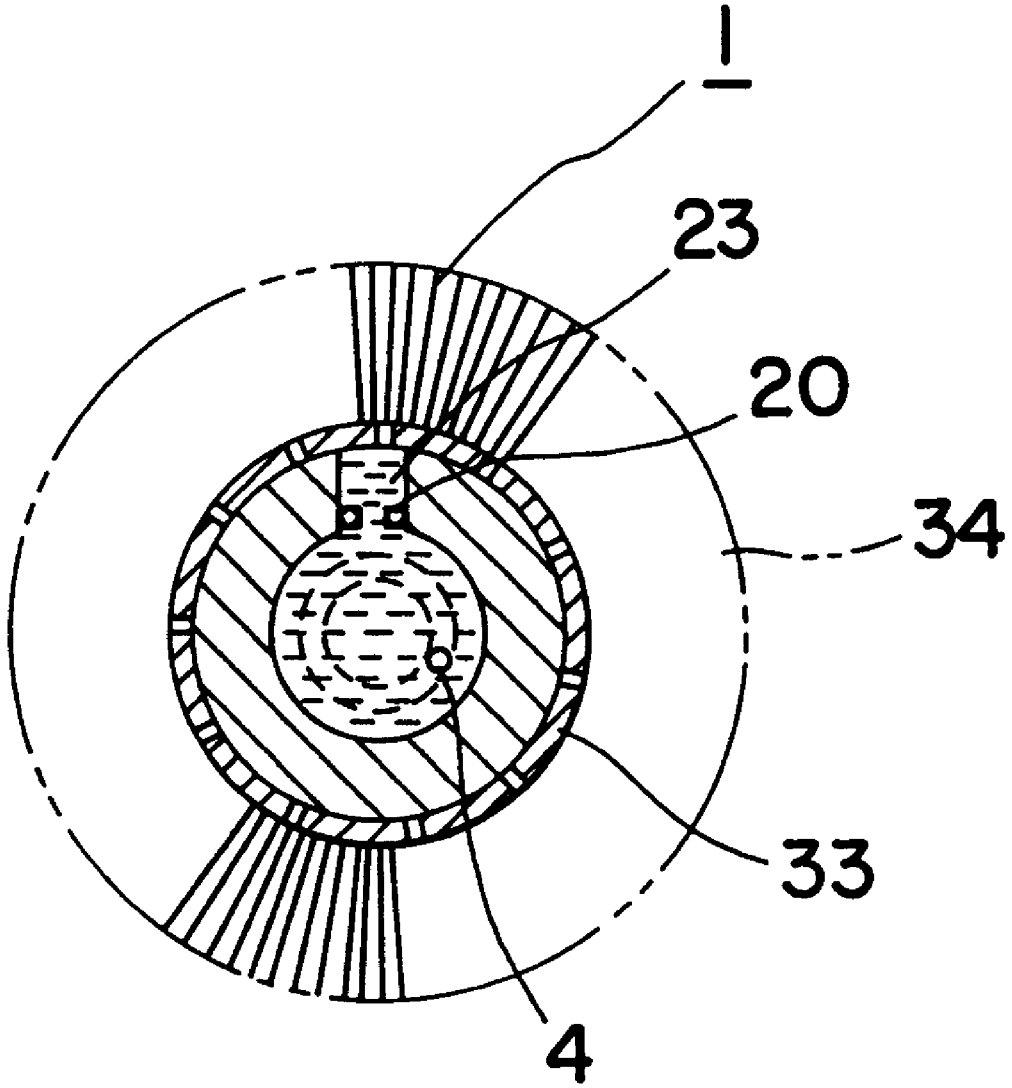
FIG. 5 is a sectional view taken A—A showing the state in which a coating flows in FIG. 4.

As shown in FIGS. 2 to 4, in the core body 19, a coating supplying groove 23 along the shaft-center direction is formed in one side part in a peripheral direction of an intermediate portion in the shaft-center direction of an outer peripheral surface of a columnar body, a small diameter portion 19*a* is formed on the proximal side of the columnar body, a somewhat small diameter closing-body mounting portion 24 is formed on the extreme end side of the columnar body, stopping projections 25, 25 are formed in the outer peripheral surface of the closing-body mounting portion 24, a coating flowing hole 26 is provided over the intermediate portion in the shaft-center direction from the proximal end of the columnar body, a stopping shoulder 27 is formed in the intermediate portion of the coating flowing hole 26, a coating outflow port 28 communicated with the coating supplying groove 23 is formed on the extreme end side of the coating flowing hole 26, and a cavity 30 opened to the extreme end surface of the core body 19 through a diaphragm which is formed on the extreme end side of the coating flowing hole 26.

The adjusting plate 20 is that as shown in FIG. 3, stopping portions 20*b*, 20*b* are extended on both ends of the bottom portion of a groove-shaped portion 20*a* which is slightly shallower in bottom than the coating supplying groove 23, and small holes 20*c*, 20*c*, . . . are bored in the bottom portion at suitable intervals in the shaft-center direction. As shown in FIGS. 3 and 4, the stopping portion 20*b* is held by a pressing member 29 threadedly mounted on the proximal end of the coating supplying groove 23, and the stopping portion 20*b* on the extreme end side is held between the closing-body mounting portion 24 and the closing body 21 and fixed within the coating supplying groove 23.

The closing body 21 is that as shown in FIGS. 3 and 4, a somewhat spread stopping hole 21*a* is formed from the central portion of the end of the closing body 21 having a cap-shape in section toward the opening of the closing body, a fitting hole is formed on the opening side, and stopping groove portions 21*d*, 21*d* capable of engaging and guiding the stopping projections 25, 25 of the core body 19 are formed in the form of a hook in the inner surface of the peripheral wall portion 21*b*. The stopping projections 25, 25 are inserted into the stopping grooves 21*d*, 21*d*, the fitting hole of the closing body 21 is fitted in the closing-body mounting portion 24, and the closing body 21 is turned and fixedly mounted on the core body 19.

Figure 2A:
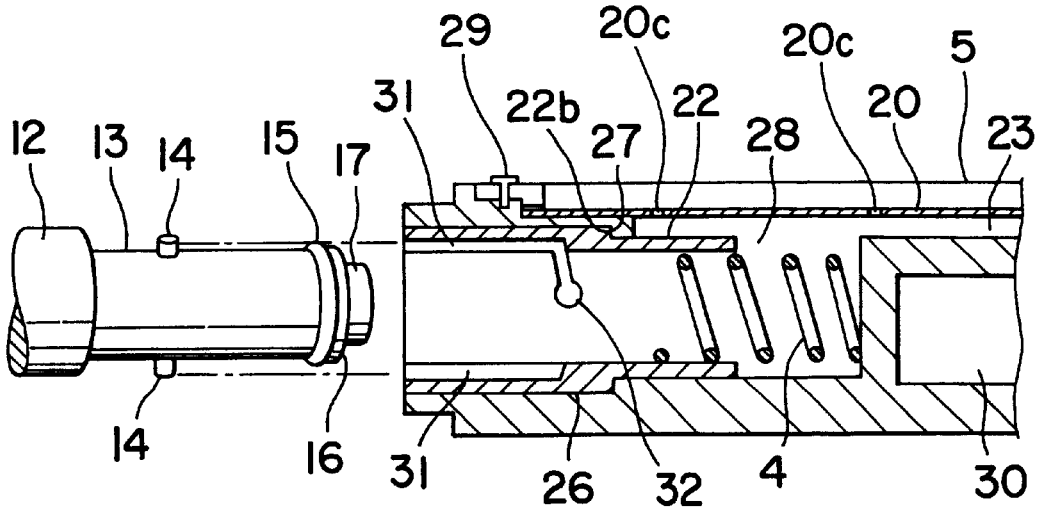
FIGS. 2(A) to (C) are respectively sectional views showing a connecting construction and a connecting means of a support and a core in the coating roller shown in FIG. 1, FIG. 2(A) being a view showing the state before connection, FIG. 2(B) being a view showing the state of the midst of connection, FIG. 2(C) being a view showing the state after connection.

The fitting body 22 is that as shown in FIGS. 2 to 4, the extreme end from the intermediate portion of the cylindrical member 22*a* is made to have a small diameter portion, the engaging shoulder 22*b* is formed in the outer peripheral portion, and inserting grooves 31, 31 are formed in the proximal opening portion so as to engage and guide the stopping projections 14, 14 of the support 2 to the inner peripheral portion of the cylindrical member 22*a*. As shown in FIG. 2A, the engaging shoulder 22*b* is stopped and fitted at the stopping shoulder 27 formed within the coating flowing hole 26.

Figure 2B:
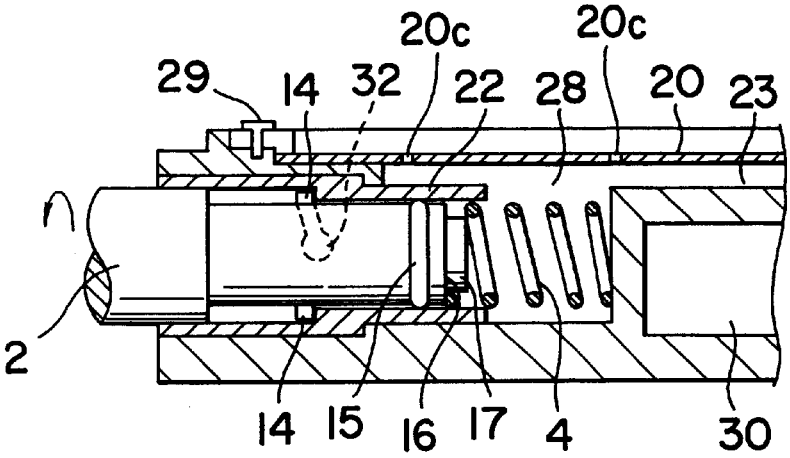
Figure 2C:
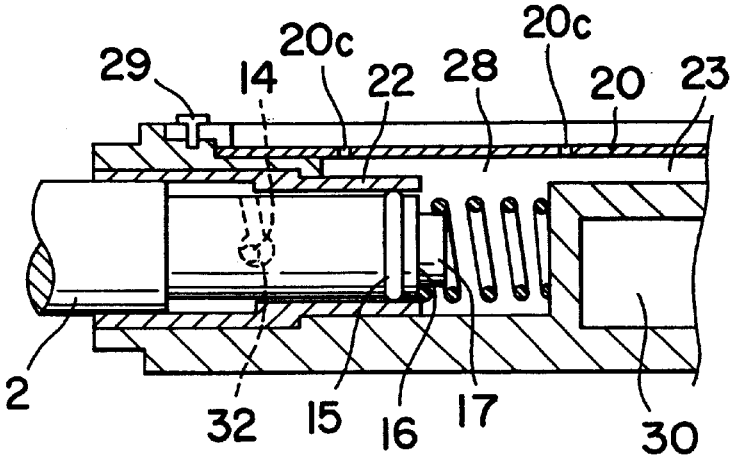

More specifically, the fitting groove 31 is moved straight on somewhat from the proximal opening toward the inner part of the axial hole and after this, moves-in in a helical direction (this portion is called a helical portion). The helical portion is formed in the inner end thereof with a hemispheric stopping groove 32. In the state in which the spring 4 is mounted within the coating flowing hole 26 as shown in FIG. 2, the stopping projections 14, 14 are inserted into the inserting grooves 31, 31 and the extreme end of the support 2 is inserted into the coating flowing hole 26 as shown in FIG. 2(B), and subsequently the support 2 is turned in a predetermined direction to cause the stopping projection 14, 14 to arrive at the stopping grooves 32, 32 as shown in FIG. 2(C). Then, the spring 4 is pressed by the spring stopping portion 16, and the stopping projection 14 is elastically urged by repulsion of the spring 4 and is stopped at the stopping groove 32. With the mounting construction as described above, the core 5 can be detachably mounted on the support 2 easily in one touch manner, and the core 5 can be always mounted on the support 2 in the same direction (on the side opposite the holder 10 in FIG. 1).

Figure 6A:
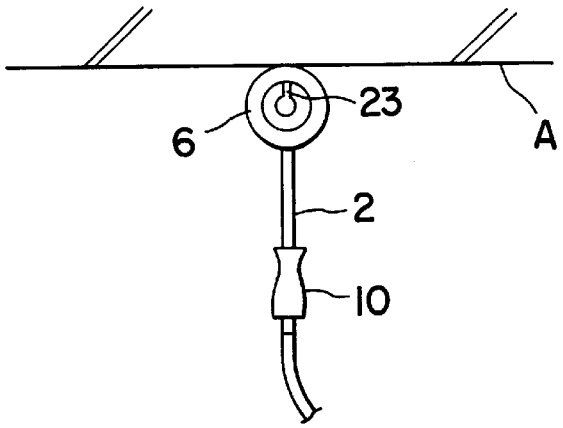
FIGS. 6(A) to (C) are respectively side views showing the using state of the coating roller shown in FIG. 1, FIG. 6(A) showing the using state in the case where a ceiling, surface is coated, FIG. 6(B) showing the using state in the case where a wall surface is coated, FIG. 6(C) showing the using state in the case where a floor surface is coated.
Figure 6B:
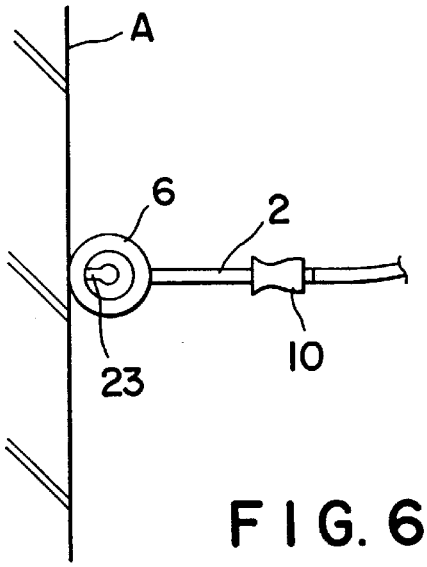
Figure 6C:
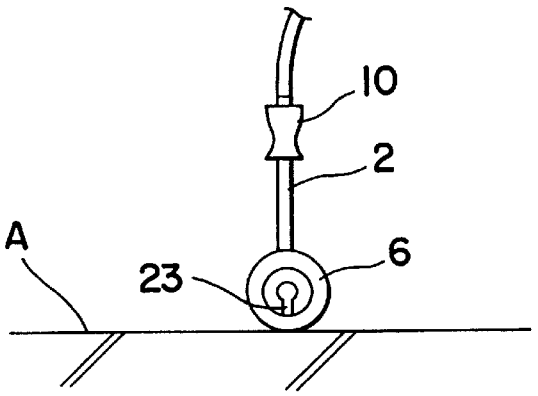

With respect to the direction for fixing the core 5, preferably, the core 5 is disposed on the support 2 so that the coating supplying groove 23 faces to the coating surface A, that is, so that the coating supplying groove 23 is positioned opposite the holder 10, as shown in FIG. 4 and FIGS. 6(A), (B) and (C).

The roller 6 is formed such that as shown in FIGS. 1 and 4, a number of fibers 34 are provided on the outer peripheral surface of a cylindrical body 33 bored with a number of pores 33*a*, 33*a*. As shown in FIG. 4, the core 5 is inserted into the cylindrical body 33, and the cap 3 on the proximal side and the cap 7 on the extreme side are mounted on both ends of the cylindrical body 33 and rotatably mounted on the support 2.

Further, the cap 7 on the extreme end side is configured such that as shown in FIGS. 1 and 4, a depression opened to the extreme end is formed and an outer peripheral surface thereof is made to constitute a roller supporting portion 7*a*, an open end of the roller supporting portion 7*a* is risen to form an annular stopping portion 7*b*, and an inserting hole 7*c* is provided in the proximal end of the losing, body. This is mounted on the extreme end of the core 5 rotatably about a mounting member 8 which will be described below.

The mounting member 8 is configured such that as shown in FIGS. 1 and 4, a circular tube-like portion 8*a* capable of being inserted into the stopping hole 21*a* of the closing body 21 of the core 5 is formed, a spread portion 8*b* comprising a plurality of closeable divisions is provided on the extreme end of the circular tube-like portion 8*a*, and a disk-like portion 8*c* is provided on the proximal end of the circular tube-like portion 8*a*.

A mounting member 9 is configured such that a cylindrical portion 9*a* capable of being inserted into the circular tube-like portion 8*a* of the mounting member 8, a pressing portion 9*b* capable of spreading the spread portion 8*b* is provided on the extreme end of the cylindrical portion 9*a*, a disk-like portion 9*c* is provided on the proximal end of the cylindrical portion 9*a*, upper portions of the extreme ends of the disk-like portion 9*c* and the cylindrical portion 9*a* are partly cut, and a knob 9*d* is riseably provided with the cylindrical portion 9*a*.

In these mounting member 8 and mounting member 9, as shown in FIG. 4, the spread portion 8*b* is inserted into the stopping hole 21*a* of the closing body 21 through the inserting hole 7*c* of the cap 7 on the extreme end side, under which state the cylindrical portion 9*a* is inserted into the circular tube-like portion 8*a*, and the spread portion 8*b* is spread by the pressing portion 9*b*, engaged and pressed in the stopping hole 21*a*, and mounted on the extreme end of the core 5.

The mounting member 9 can be easily disengaged from the core 5 by falling and pulling the knob 9*d*. Thereby, the mounting member 8 and the roller 6 can be easily disengaged from the core 5 in said order.

The holder 10 is configured that a mounting portion 10*b* capable of being connected to the connecting member 18 is provided on the upper end of a holding portion 10*a* having a coating passage therein, and a connecting portion 10*c* capable of connecting a coating hose 35 is provided on the low end thereof.

The coating roller 1 being constructed as described above, one end of the coating hose 35 having the other end connected to the coating apparatus is connected to the connecting portion 10*c* of the holder 10, and when coating is fed under pressure by the coating apparatus, the coating flows into the core 5 through the holder 10 and the support 2, and flows into the lower side of the adjusting plate 20 within the coating supplying groove 23 through the coating outflow port 28, from which the coating is distributed and supplied to the roller 6 through the pores 20*c*, 20*c*, . . . of the adjusting plate 20.

Accordingly, according to the coating roller 1, a coating reservoir between the roller 6 and the core 5 occurs merely within the coating supplying groove 23, that is, merely one side part in the peripheral direction, and therefore, extra coating will not stay between the core 5 and the roller 6. Moreover, since the coating supplying groove 23 is provided in the shaft-center or axial direction, the coating can be supplied evenly over the entire width of the roller 6, enabling elimination of a drip of coating and uneven coating.

Further, since the core 5 can be detachably mounted on the support 2 in one touch manner, assembly and disassembly are extremely easy, and in addition, no looseness occurs during coating as in the conventional thread system.

Furthermore, unlike the thread system, since the core 5 can be mounted and fixed so as to be directed in the same direction always, the fuel supplying groove 23 can be set so as to face to the coating surface A, and coating can be achieved without unevenness and evenly with a small quantity of coating.

Next, as a second embodiment of the present invention, a preferred embodiment of a coating apparatus will be described below.

Figure 10:
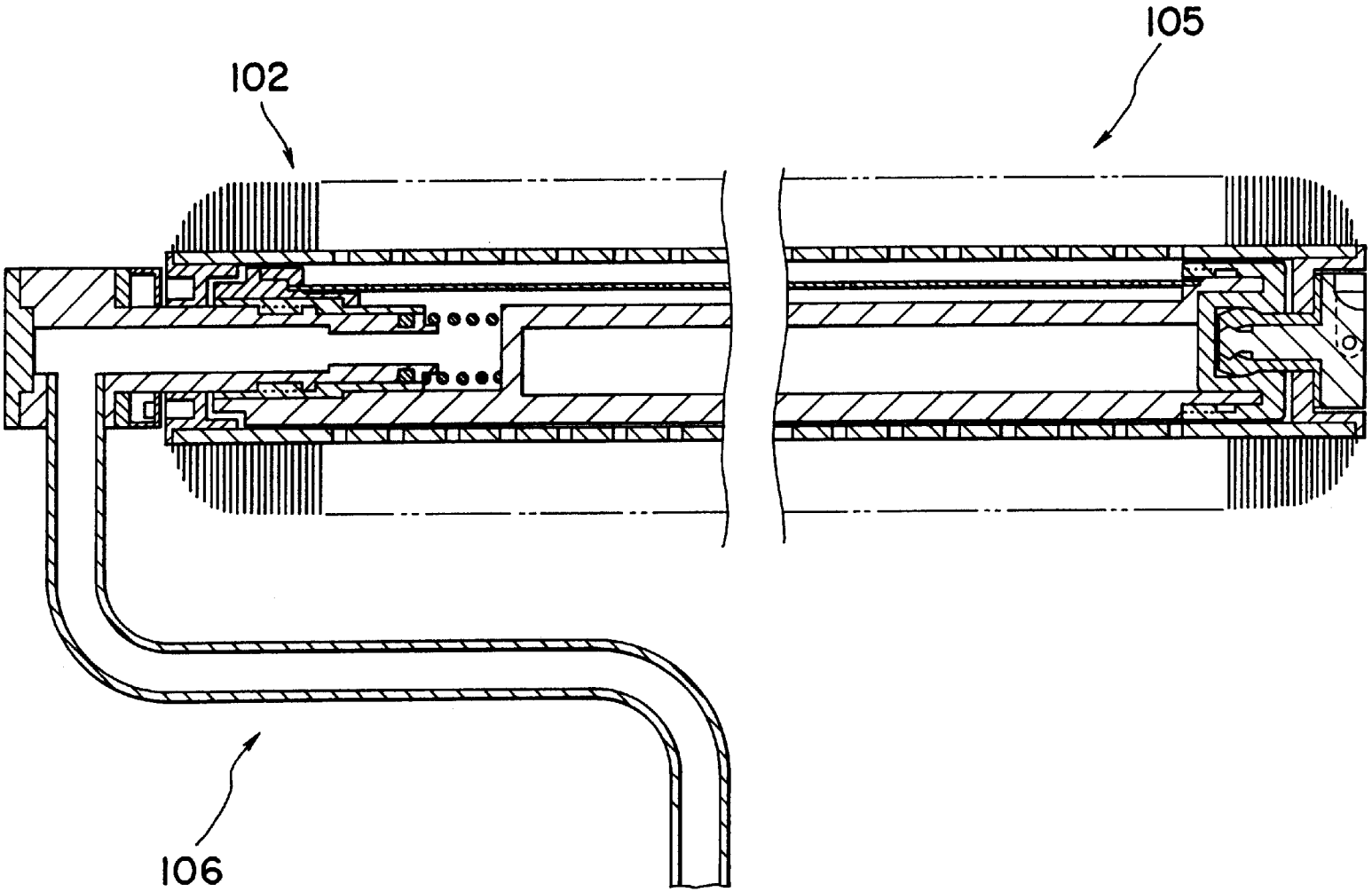
FIG. 10 is a sectional view of the state in which the coating roller shown in FIG. 9 is assembled.
Figure 13:
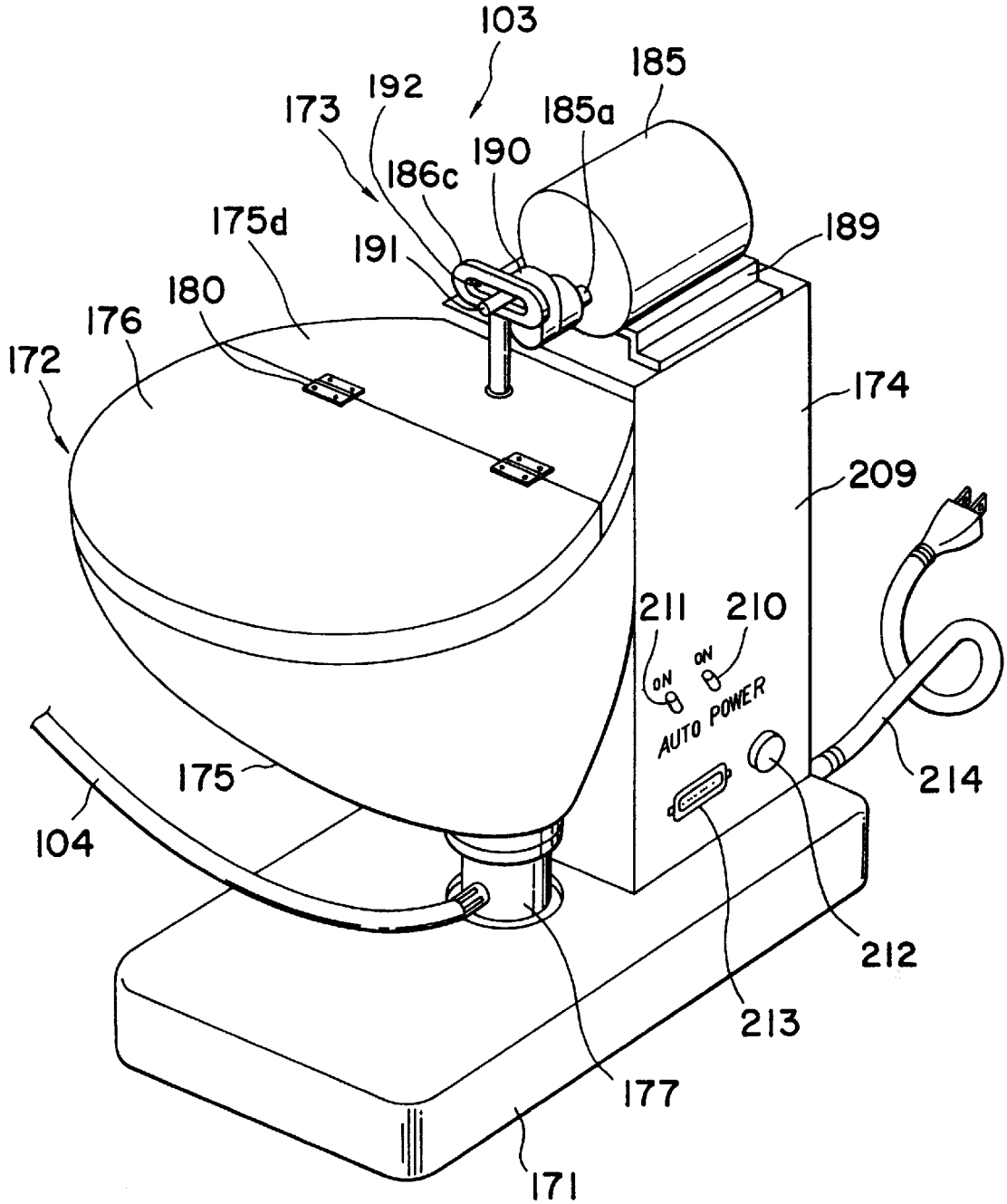
FIG. 13 is a perspective view of a coating supplying apparatus according to a second embodiment.

The coating apparatus according to the second embodiment of the present invention comprises a coating roller 102, a coating supplying apparatus 103, and a hose 104, as shown in FIGS. 10 and 13.

Figure 9:
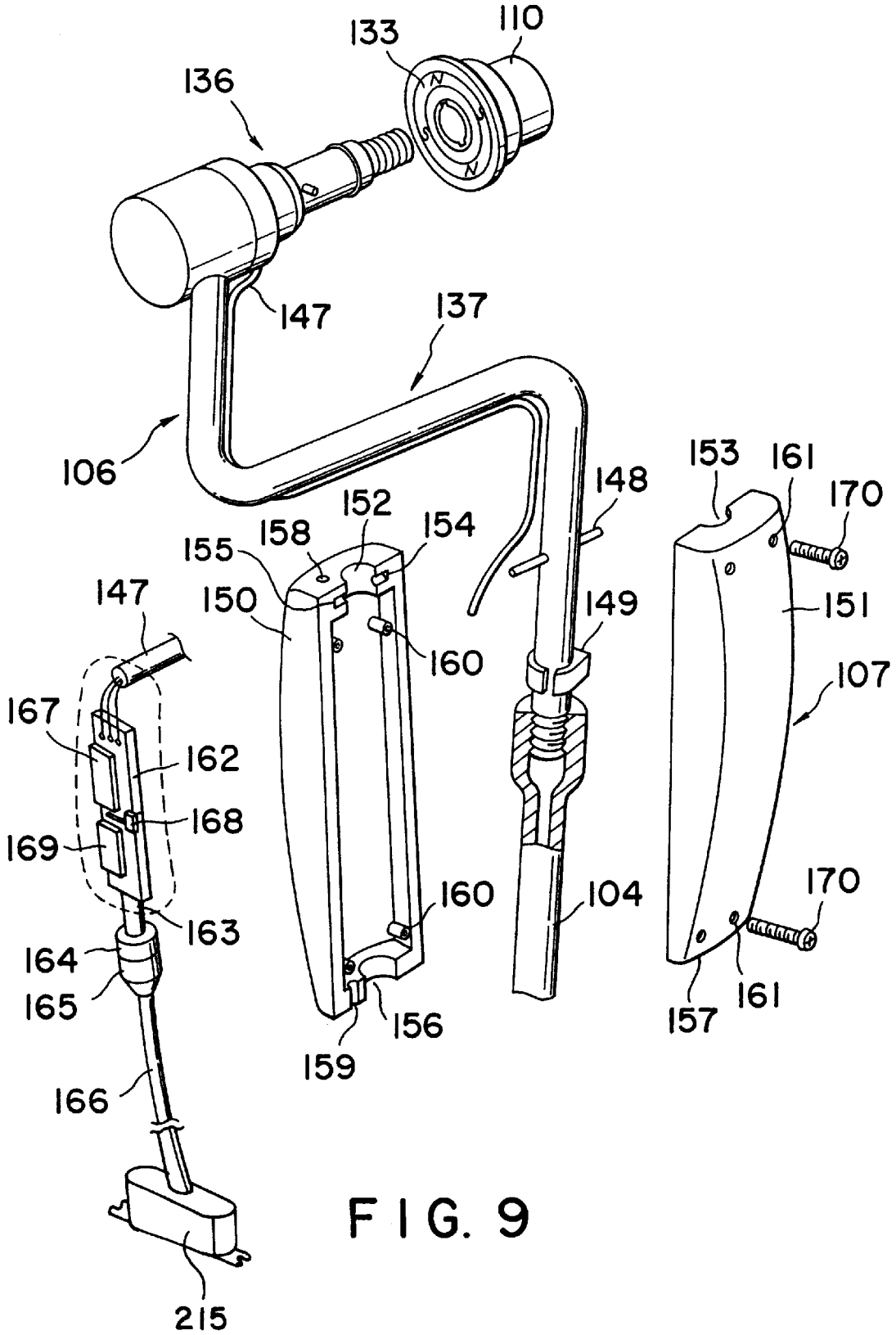
FIG. 9 is a perspective view of the state in which a coating roller according to a second embodiment is exploded.

The coating roller 102 makes use of the construction of the above-described coating roller 1. However, the coating roller 102 is slightly different from the former and will be newly explained. The coating roller 102 comprises a roller 105, a support 106, and a holder 107, as shown in FIGS. 9 and 10.

Figure 11:
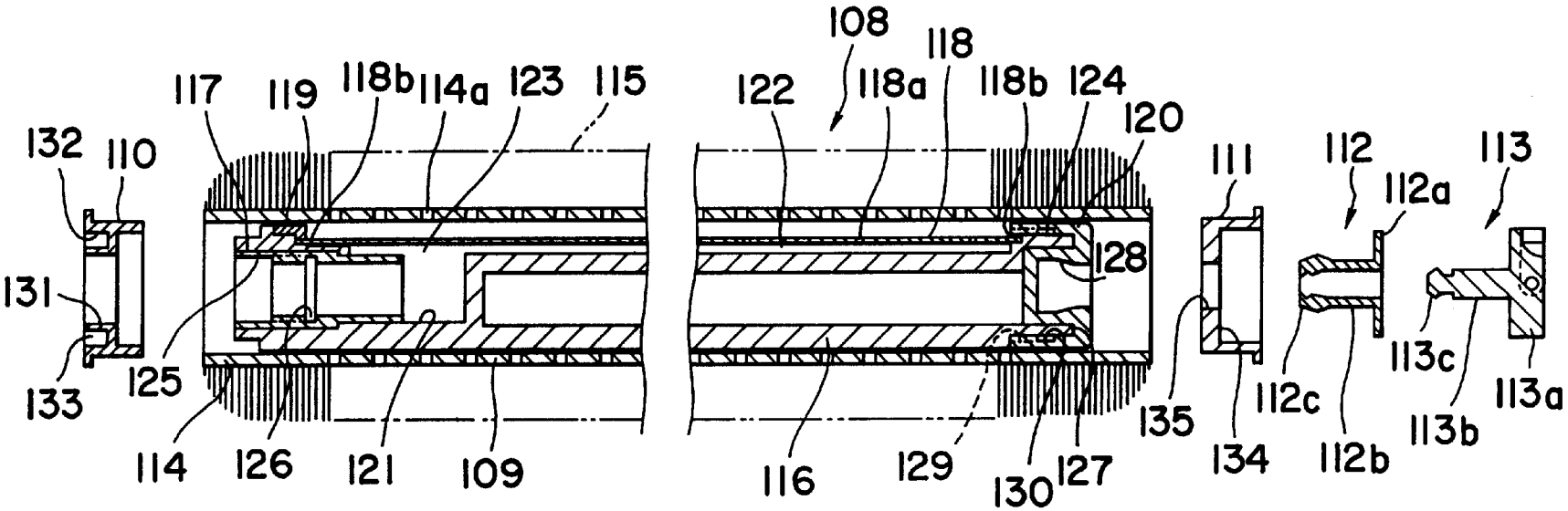
FIG. 11 is a sectional view of the state in which the roller shown in FIG. 10 is exploded.

The roller 105 is configured such that as shown in FIG. 11, a core 109 is mounted within a brush 108, caps 110, 111 and fitted from both sides of the brush 108, and the core 109 is fixed by mounting members 112, 113.

The brush 108 is configured such that as shown in FIG. 11, a number of fibers 115 are provided on the outer peripheral surface of a cylindrical body 114 bored with a number of pores 114*a*, 114*a*, . . . .

The core 109 comprises a core main body 116, an inserting body 117, an adjusting plate 118, a pressing member 119, and a closing body 120 as shown in FIG. 11.

The core main body 116 is configured such that a coating flowing hole 121 is formed at the rear end thereof, a coating flowing groove 122 is formed in the outer peripheral surface extending from the extreme end to the rear end, and the coating flowing hole 121 and the coating flowing groove 122 are communicated through a coating outflow port 123. Further, a stopping projection 124 is formed on the outer peripheral surface of the extreme end.

The inserting body 117 is configured such that an inserting groove 125 is formed axially in the inner peripheral surface thereof, a stopping groove 126 is formed in a peripheral direction, and is fitted in a flowing hole 121 at the rear end of the core main body 116.

The adjusting plate 118 is configured such that pores 118*a*, 118*a*, . . . are bored at suitable intervals longitudinally, both ends constituting stopping portions 118*b*, 118*b*, which are placed in contact with the front end and the rear end of the core main body 116 to cover the coating flowing groove 122. The stopping portion 118*b* in contact with the rear end is fixed by the pressing member 119.

The closing body 120 is configured such that a fitting hole 127 and a stopping hole 128 are formed in one side and the other, respectively, an inserting groove 129 is formed axially in the inner surface of the fitting hole 127, and a stopping groove 130 is formed in the peripheral direction.

The stopping projection 124 is inserted into the inserting groove 126 so that the extreme end of the core main body 116 is fitted into the fitting hole 127, and subsequently, the closing body 120 is turned to fit the stopping projection 124 into the stopping groove 130, the closing body 120 is mounted on the core main body 116, and at the same time, the stopping portion 118*b* in contact with the front end is fixed.

The cap 110 is formed with an inserting hole 131 and formed with an annular groove 132, and an annular magnet 133 having N pole and S pole are arranged at peripherally predetermined intervals is fitted into the annular groove 132.

The cap 111 is formed with a depression 134, which is in turn formed with an inserting hole 135.

The caps 110 and 111 are mounted on both ends of the cylindrical body 114.

The mounting member 112 is configured such that the circular tube-like portion 112*b* is connected to a disk-like portion 112*a*, and the extreme end of the circular tube-like portion 112*b* made to have a somewhat large diameter and is peripherally divided into four sections to constitute a spread portion 112*c*, inside diameter of which is somewhat small.

The mounting member 113 is configured such that a cylindrical portion 113*b* is connected to a disk-like portion 113*a*. The extreme end of the cylindrical portion 113*b* is made to have a somewhat large diameter to constitute a pressing portion 113*c*.

The circular tube-like portion 112*b* of the mounting member 112 is inserted into the inserting hole 135 of the cap 111, the spread portion 112*c* is positioned in the stopping hole 128 of the closing body 120 and subsequently, the cylindrical portion 113*b* of the mounting member 113 is inserted into the inner hole of the circular tube-like portion 112*b* of the mounting member 112, the spread portion 112*c* is spread in a diametrical direction and the cap 111 and the closing body 120 are integrated by the mounting members 112 and 113.

Figure 12:
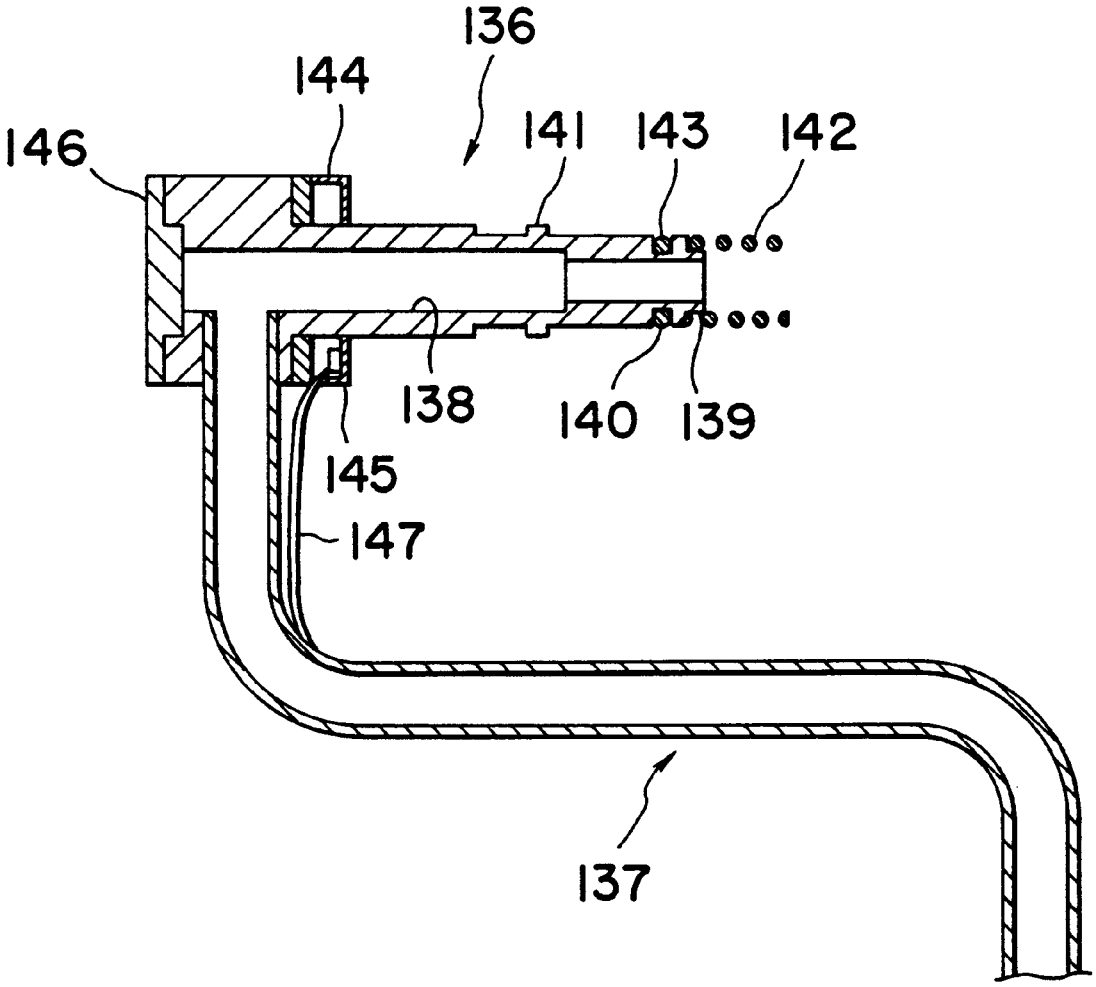
FIG. 12 is a sectional view of the support shown in FIG. 9.

The support 106 comprises a support shaft 136 and a support lever 137 as shown in FIG. 12.

A through-hole 138 is axially bored in the support shaft 136, a spring stopping portion 139 and an O-ring fitting groove 140 are formed in the extreme end, and a stopping projection 141 is formed in the intermediate portion. One end of a spring 142 is stopped at the spring stopping portion 139, and an O-ring 143 is fitted in the O-ring fitting groove 140.

The rear end of the support shaft 136 is made to have a large diameter, on the right side of which a rotation detection element 145 is disposed within a cover 144 made of plastic, and a lid 146 is secured to the left side thereof, and one end of the support lever 137 is secured to the lower end thereof.

As the rotation detection element 145, two Hall elements 145*a*, 145*b* are used, and cords 147*a*, 147*b* are derived from the Hall elements 145*a*, 145*b*.

The support lever 137 is a tubular body with an intermediate portion bent. A pin 148 is secured, a C-shaped magnet 149 is fitted, and one end of the hose 104 is connected to the other end thereof.

The extreme end of the support shaft 136 is inserted into the inserting hole 131 of the cap 110, the stopping projection 141 is inserted into the inserting groove 125 of the fitting body 117, and subsequently the support shaft 136 is turned to fit the stopping projection 141 into the stopping groove 126, and the support shaft 136 is mounted on the core main body 116.

Thereby, the support shaft 136 is integrated with the core 109 without being disengaged easily, and the brush 108 can be freely rotated with respect to the support shaft 136.

Figure 17:
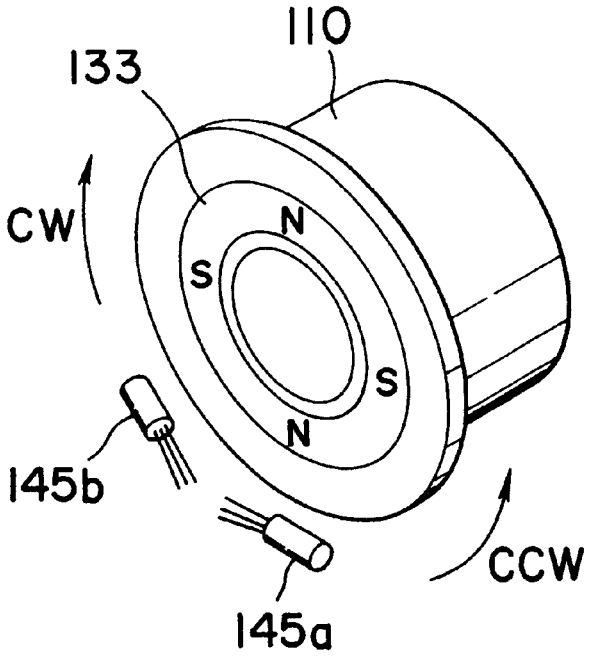
FIG. 17 is an explanatory view showing a positional relationship between an annular magnet and a Hall element.

When the support shaft 136 is mounted, the annular magnet 133 is opposed to the Hall element 145*a*, 145*b* in a predetermined spaced relation, as shown in FIG. 17, and the peripheral spacing of the N pole and S pole of the annular magnet 133 is set to be approximately ½ of that of the Hall elements 145*a*, 145*b*, as shown in FIG. 17.

The holder 107 comprises two divisions 150, 151 as shown in FIG. 9. The divisions 150, 151 are formed in their upper ends with support lever inserting grooves 152, 153 and pin fitting grooves 154, 155, and in their lower ends with hose inserting grooves 156, 157.

The division 150 is bored in its upper and lower ends with cord inserting holes 158, 159 to form threaded holes 160, 160, . . . while the division 151 is bored with inserting holes 161, 161, . . . .

One end of the cord 147 is inserted through the cord inserting hole 158, a circuit substrate 162, a cord 163 and a connector 164 are arranged within the divisions 150, 151, a connector 165 is connected to the connector 164, and one end of a cord 166 is derived from the cord inserting hole 159.

On the circuit substrate 162 are arranged a rotary encoder 167, a Hall element 168, and a logic circuit 169. Preferably, the circuit substrate 162 is shielded or molded so as not to be stained with coating. A pin 148 secured to the support lever 137 is fitted in the pin fitting grooves 154, 155, the support lever 137 is positioned in the support lever inserting grooves 152, 153, the hose 104 is positioned in the hose inserting grooves 156, 157, threads 170, 170, . . . are inserted into the inserting holes 161, 161, . . . of the division 151 and engaged with thread holes 160, 160, . . . whereby the support 106 and the holder 107 can be integrated.

At this time, the support lever 137 can be oscillated about the pin 148, and the C-shaped magnet 149 is opposed to the Hall element 168 in a predetermined spaced relation.

The coating supplying apparatus 103 comprises a base 171, a coating tank 172, a coating feed mechanism 173, and a control device 174, as shown in FIG. 13.

Figure 14:
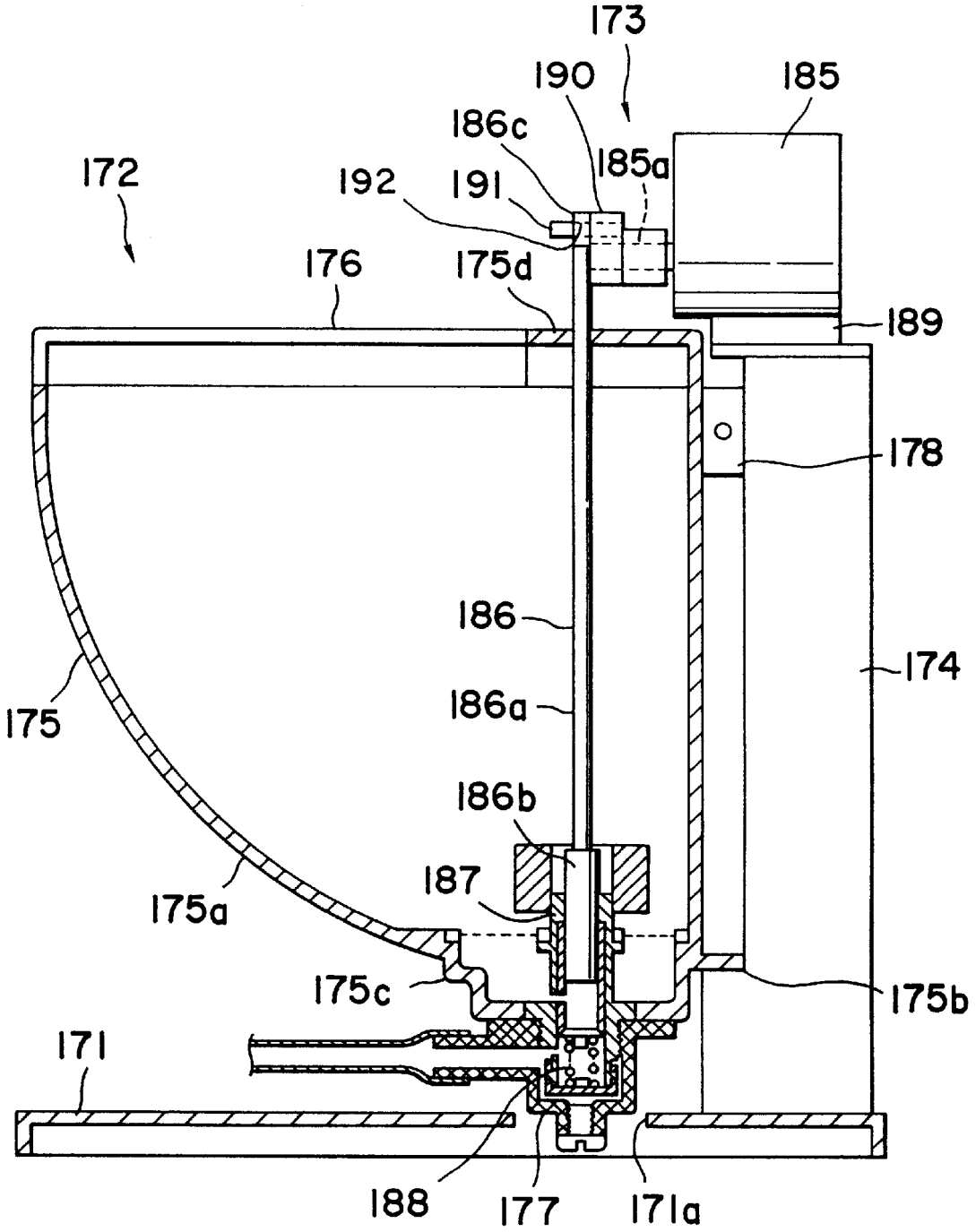
FIG. 14 is a sectional view of a coating supplying apparatus.
Figure 15:
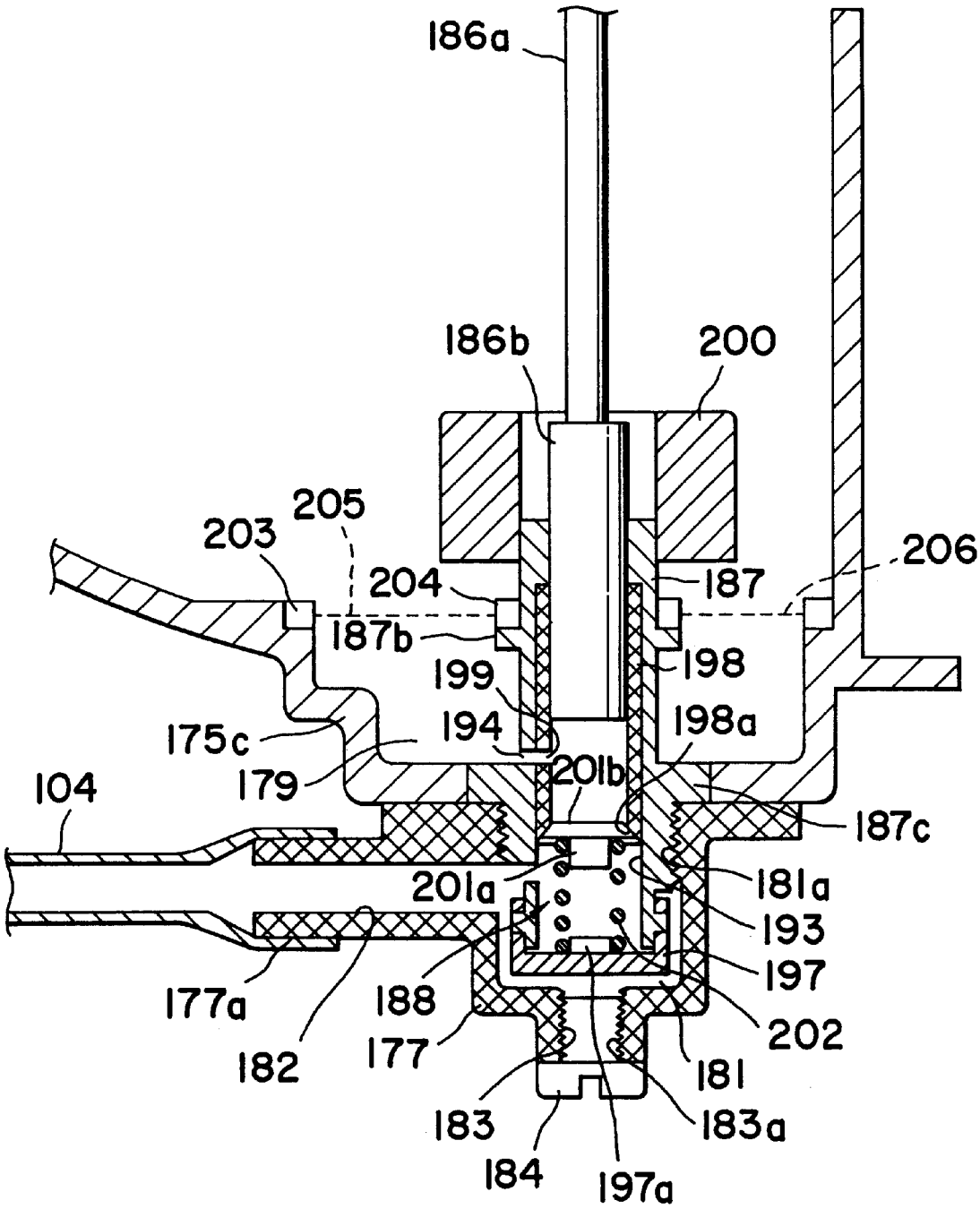
FIG. 15 is a sectional view of a coating feed mechanism.

The coating tank 172 comprises a main body 175, a lid 176, and a mounting member 177, as shown in FIG. 14.

The main body 175 is supported on the control device 174 by a support portion 175*b* projected on a side wall 175*a* and a fixed support member 178 and being gradually reduced in diameter toward the lower portion of the side wall 175*a* and projected downward to form a depression 175*c*, bottom of which is bored with a fitting hole 179.

The lid 176 is rotatably mounted on an upper wall 175*d* of the main body 175 through a hinge 180.

The mounting member 177 is secured to the bottom of the depression 175*c* and formed in one side with an engaging portion 177*a*, and a lower end thereof is positioned in a hole 171*a* bored in the base 171.

Further, a cylinder inserting hole 181 is bored in the central portion, an internal thread 181*a* is formed in the upper portion of the cylinder inserting hole 181, and a supply flow passage 182 and a discharge flow passage 183 are formed horizontally and vertically, respectively, from the cylinder inserting hole 181, the discharge flow passage being formed with an internal thread 183*a*.

The other end of the hose 104 is engaged with the engaging portion 177*a*, and a dead water plug 184 is mounted on the internal thread 183*a* by threading.

The coating feed mechanism 173 comprises a motor 185, a piston 186, a cylinder 187, and an outflow mechanism 188, as shown in FIG. 14.

The motor 185 is secured to the upper surface of the control device 174 through a support member 189, a cam 190 is secured to a motor shaft 185*a*, and a function pin 191 is secured to the cam 190.

The piston 186 is configured such that a sliding portion 186*b* is connected to the lower end of a lever-like portion 186*a*, a pin guide 186*c* is connected to the upper end thereof, and the pin guide 186*c* is formed with a pin guide hole 192 (as best seen in FIG. 13).

A function pin 191 is fitted into the pin guide hole 192, and when the motor shaft 185*a* is rotated, the function pin 191 rotates whereby the piston 186 is moved up and down.

Figure 16:
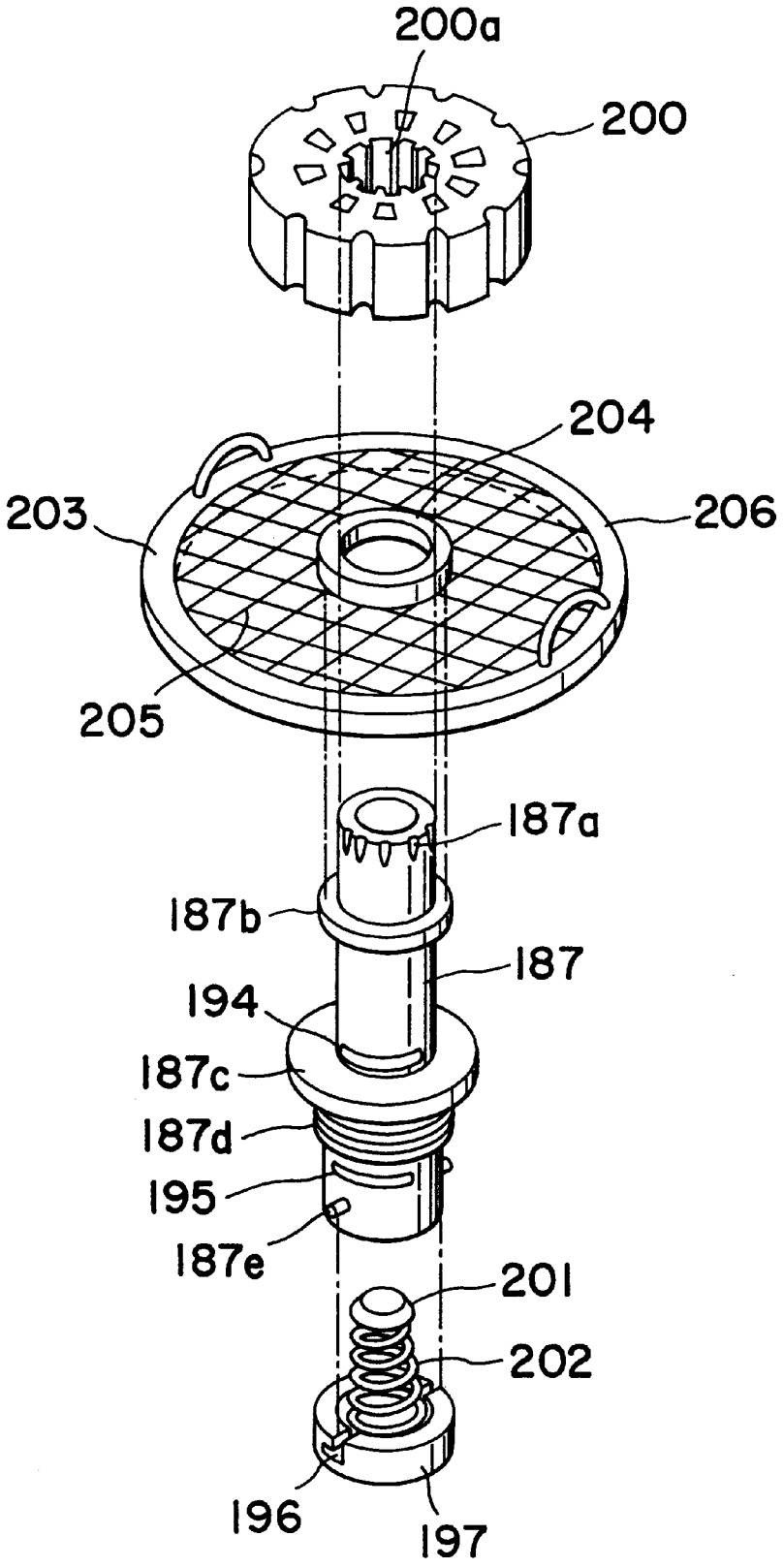
FIG. 16 is a perspective view of the state in which a cylinder is exploded.

The cylinder 187 is configured such that as shown in FIG. 16, a plurality of engaging grooves 187*a*, 187*a*, . . . are formed in the upper end, a collar-like portion 187*b* and a fitting portion 187*c* are formed in the intermediate portion, a coating inlet 194 communicated with an inner hole 193 is bored in the upper side of the fitting portion 187*c*, and an external thread 187*d* is formed in the lower side thereof. A coating outlet 195 is bored in the lower end thereof, and a stopping projection 187*e* is projected.

A stopping groove 196 is cut in the side wall, a closing member 197 having a stopping portion 197*a* projected is provided on the bottom wall, a stopping projection 187*e* is fitted into the stopping groove 196, and the closing member 197 is rotated to close the lower opening of the cylinder 187.

A guide member 198 for guiding the sliding portion 186*b* of the piston 186 is fitted in the inner hole 193 of the cylinder 187, a coating inlet 199 is bored in the peripheral wall of the guide member 198, and the lower end is made into an inclined surface to serve as a valve seat 198*a*.

For mounting the cylinder 187, there is used a fastening member 200 formed in its inner peripheral surface with convex portions 200*a*, 200*a*, . . . The convex portions 200*a* are engaged with the engaging groove 187*a*, and the fastening member 200 is rotated to cause the external thread 187*d* of the cylinder 187 to engage the internal thread 181*a* of the mounting member 177. Then the fitting portion 187*c* is closely fitted in the fitting hole 179 of the depression 175*c*, and the lower end is positioned in the cylinder inserting hole 181 to mount the cylinder 187.

The outflow mechanism 188 is disposed in the inner hole 193 of the cylinder 187, and both ends of a spring 202 are stopped at a stopping shaft portion 201*a* of a valve member 201 and a stopping projection 197*a* of the closing member 197 to elastically urge the valve member 201 always upward. Thereby, a valve body 201*b* of the valve member 201 is normally in contact with the valve seat 198*a* of the guide member 198.

A filter 206 having a wire 205 extended between an outer frame 203 and an inner frame 204 is provided, the outer frame 203 and the inner frame 204 are placed on the depression 175*c* and the collar-like portion 187*b*, respectively, to mount the filter 206.

The control device 174 is placed on the base 171 to encase a power supply, a circuit substrate 208 and so on therein. On a panel 209 are disposed a power switch 210, a change-over switch 211, a coating-supply adjusting dial 212 and a connector 213, and a power supply cord 214 is derived therefrom.

A connector 215 (see FIG. 9) secured to one end of the cord 166 is connected to the connector 213.

Next, the detection of rotation of the brush 108 and the control of the motor 185 will be explained hereinafter.

Figure 18:
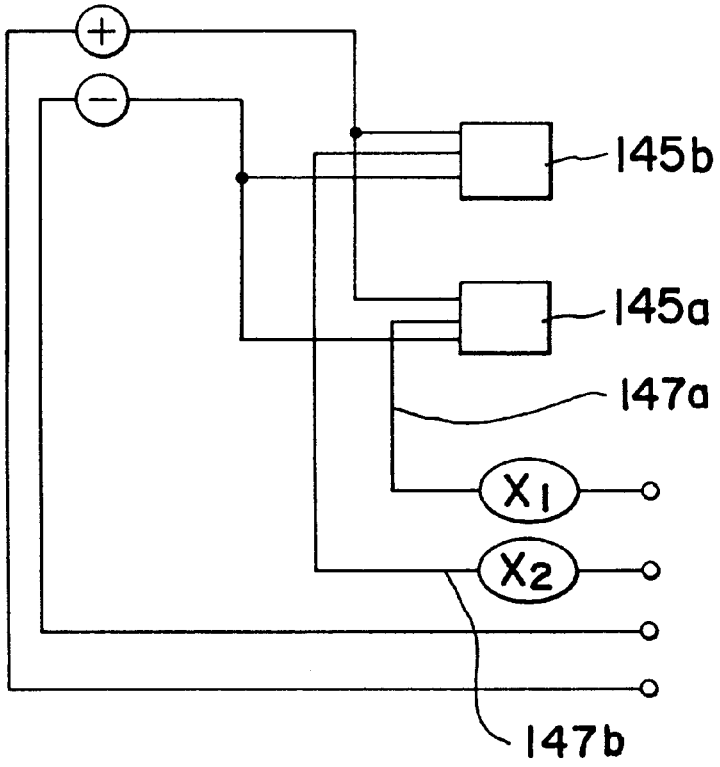
FIG. 18 is a connection diagram of the Hall element.
Figure 21:
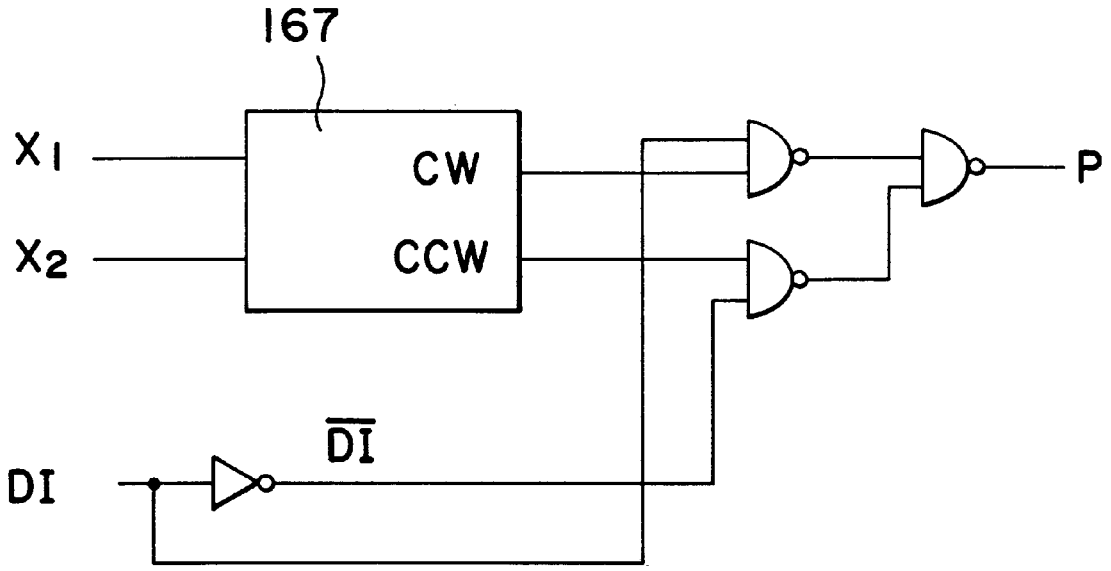
FIG. 21 is a structural view of a circuit constructed on a circuit substrate.
Figure 23:
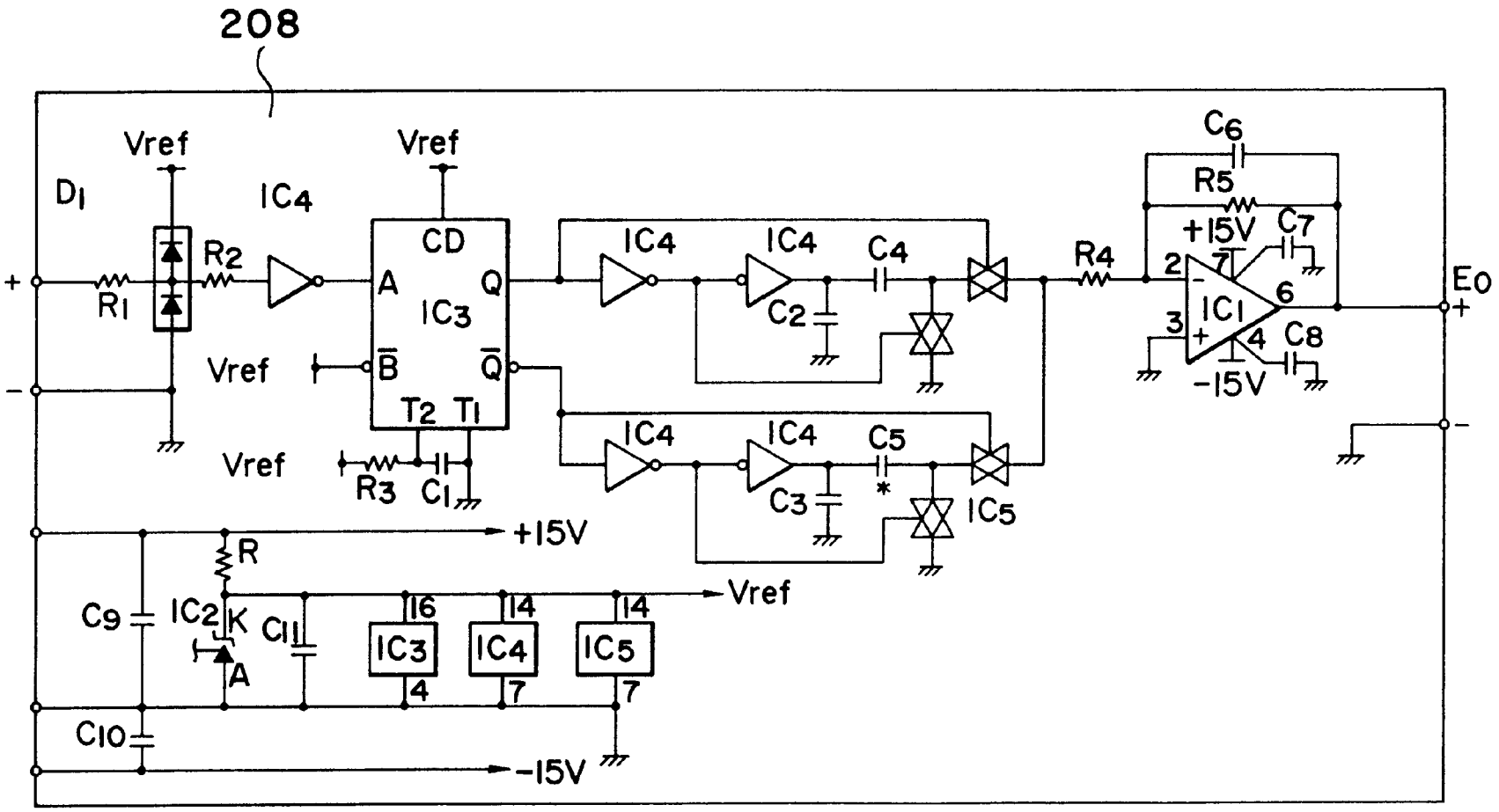
FIG. 23 is a structural view of a F-V conversion circuit.

The circuit configuration will be explained. Signal outputs of the Hall elements 145*a*, 145*b* are as shown in FIG. 18. The circuit substrate 162 has a circuit as shown in FIG. 21, and the circuit substrate 208 has an F-V conversion circuit, a voltage amplification circuit, and a motor control circuit, as shown in FIG. 23.

When the brush 108 is rotated, the annular magnet 133 also rotates. Therefore, the positional relationship between the N pole and S pole and the Hall elements 145*a*, 145*b* is varied, and output signals $X_1$, $X_2$ as shown in FIG. 19 are generated from the Hall elements 145*a*, 145*b*.

Since the peripheral spacing between the Hall elements 145*a*, 145*b* is set to approximately ½ with respect to the peripheral spacing between the N pole and S pole, the output signal $X_1$ generated from the Hall element 145*a* is deviated in phase by approximately ½ pulse width from the output signal $X_2$ generated from the Hall element 145*b*.

Accordingly, considering the output signal $X_1$ as a reference, when the annular magnet 133 rotates clockwise CW in FIG. 17, the output signal $X_2$ is as shown by the solid line, and when it rotates counterclockwise CCW, the output signal is as shown by the dotted line. Therefore, the brush 108 is changed in rotating direction due to the difference of phase as described.

Figure 19:
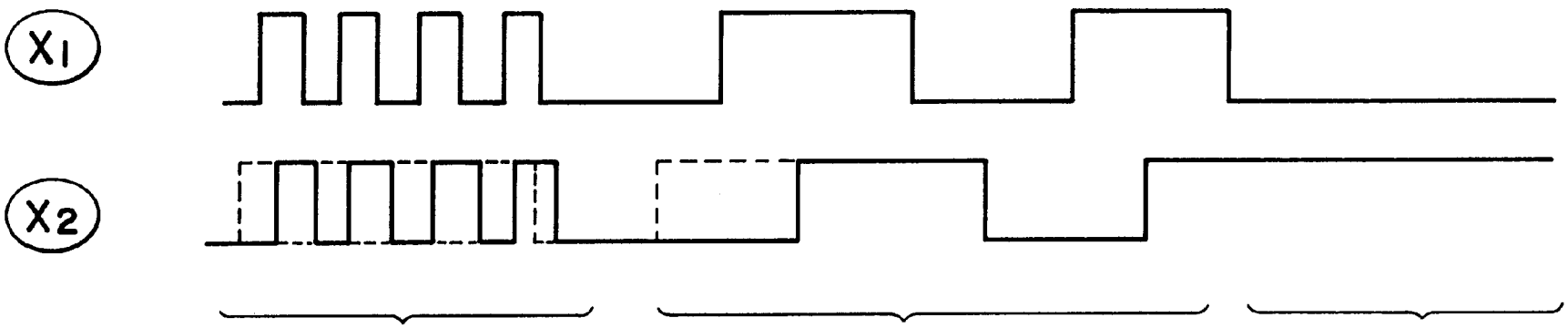
FIG. 19 is an explanatory view showing a waveform of an output signal of the Hall element.
Figure 24A:
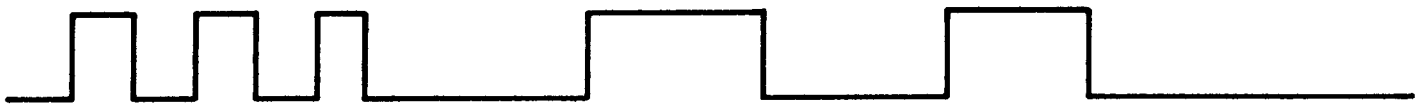
FIGS. 24(A) to (C) are respectively explanatory views showing the conversion process of a waveform of an output signal of a Hall element, FIG. 24(A) showing a signal waveform of an output signal X generated from the Hall element, FIG. 24(B) showing a signal of waveform of an output signal P in which the output signal X is converted by a one shot circuit, FIG. 24(C) showing a signal waveform of a DC signal in which the output signal P is converted by the F-V conversion circuit.
Figure 24B:
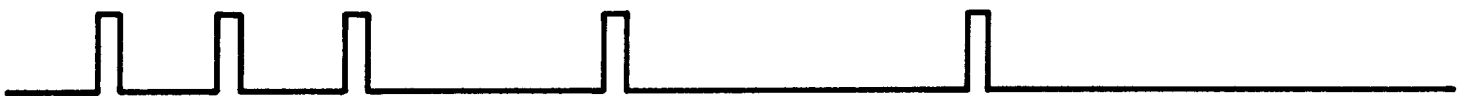

The output signals $X_1$, $X_2$ are changed in pulse width according to the rotational speed of the brush 108 as shown in FIG. 19 and FIG. 24(A) but are converted into an output signal P of a predetermined pulse width as shown in FIG. 24(B) by the one shot circuit constructed within the rotary encoder 16. As a pulse generator, a monostable multivibrator or the like can be employed.

When the support lever 137 is slightly rotated about the pin 148, the positional relation between the C-shaped magnet 149 and the Hall element 168 is varied, and a H (high) or L (low) output signal depending on the rotational direction is generated from the Hall element 168.

Figure 20A:
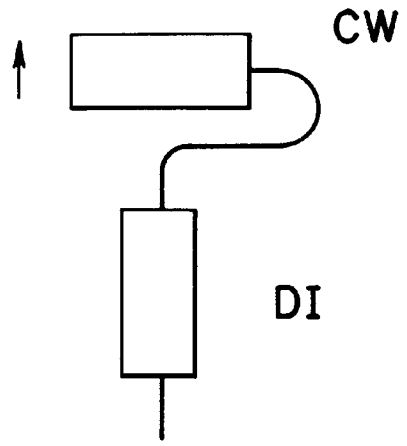
FIGS. 20(A) and (B) are respectively explanatory views showing a rotational direction of a brush and a position of a support lever, FIG. 20(A) showing the state in which the brush rotated clockwise CW, FIG. 20(B) showing the state in which the brush rotated counterclockwise CCW.
Figure 20B:
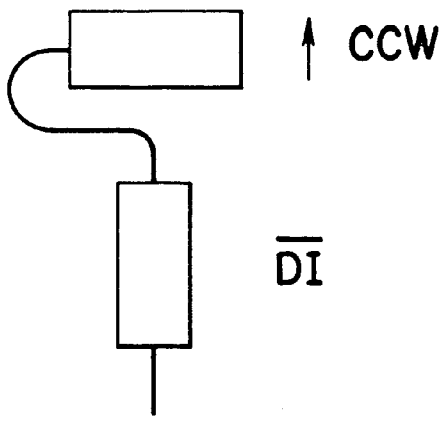

When the support lever 137 is positioned on the right side R as shown in FIG. 20(A), an output signal DI of the Hall element 168 is H (high), and when the support lever 137 is positioned on the left side L as shown in FIG. 20(B), the output signal DI of the Hall element 168 is L (low) whereby the position of the support lever 137 can be determined.

Since the circuit substrate 162 has the circuit as shown in FIG. 21, an output signal can be transmitted to the cord 166 only when the brush 108 is rotated in a predetermined condition by the output signals $X_1$, $X_2$, and DI of the Hall elements 145*a*, 145*b* and the Hall element 168.

Figure 22:
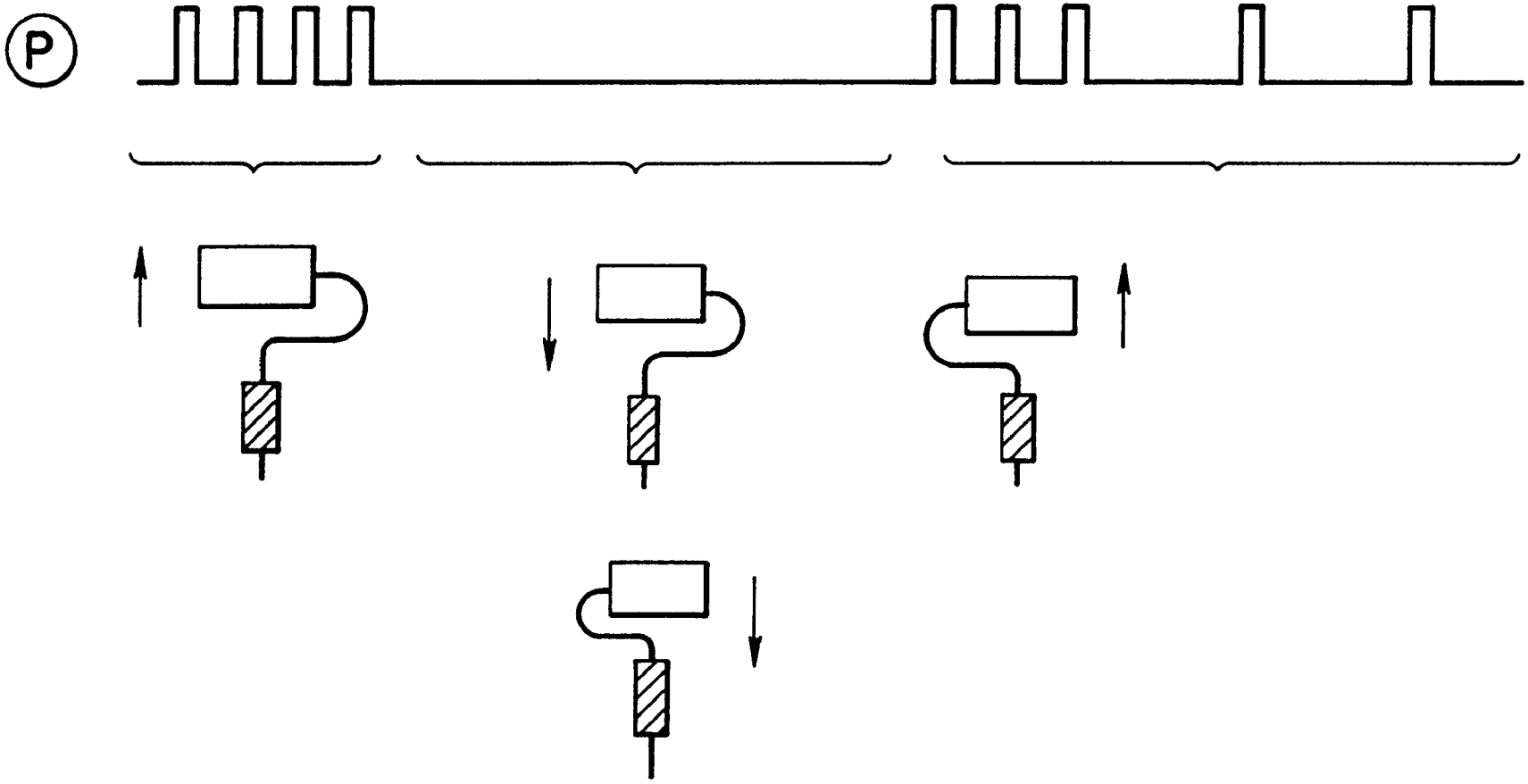
FIG. 22 is an explanatory view showing a waveform of an output signal via a logic circuit.

That is, when the support lever 137 is positioned on the right side R and the brush 108 rotates clockwise CW, and when the support lever 137 is positioned on the left side L and the brush 108 rotates counterclockwise CCW, as shown in FIG. 22, the output signal P is transmitted to the cord 166. When the support lever 137 is positioned on the right side R and the brush 108 rotates counterclockwise CCW, and when the support lever 137 is positioned on the left side L and the brush 108 rotates clockwise CW, the output signal is not transmitted to the cord 166.

Figure 24C:
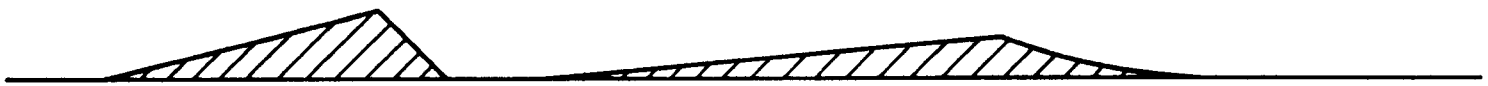

The output signal P transmitted through the cord 166 is first converted into a DC signal Q proportional to the number of pulses (frequency) generated within a predetermined time as shown in FIG. 24(C) by the F-V conversion circuit constructed within the circuit substrate 208. As the F-V conversion circuit, an integrating circuit is employed.

Next, the DC signal Q is amplified in voltage by a voltage amplification circuit constructed within the circuit substrate 208 to produce a motor driving voltage, and a motor control signal is produced by the motor control circuit. The motor shaft 185*a* is driven with suitable number of revolutions by these driving signal and control signal.

The operation and function of the coating apparatus 103 according to the present invention will be explained hereinafter.

In advance, the support 106 is connected to the roller 105, the holder 107 is connected to the support 106, and the coating roller 102 is assembled. On the other hand, the other end of the hose 104 is engaged with the engaging portion 177*a* of the coating tank 172, and the connector 215 of the signal cord 166 is connected to the connector 213.

In the operating spot, the coating supplying apparatus 103 is placed on the ground or the like, the coating roller 102 is held by one hand, the power switch 210 is turned on, and the change-over switch 211 is set to a supply control mode. Then, the brush 108 is placed in contact with the wall surface or the like to start the coating operation.

Since the coating is normally applied by pushing the coating roller 102, the coating is first applied to the wall surface or the like that is when the support lever 137 is positioned on the right side R and the brush 108 rotates clockwise CW, and the support lever 137 is positioned on the left side L and the brush 108 rotates counterclockwise CCW, and the output signal P is transmitted to the cord 166.

The output signal P is converted into the DC signal Q proportional to the number of pulses (frequency) generated within a predetermined time to produce a motor driving voltage and a motor control signal, and a voltage proportional to the number of revolutions of the brush 108 is supplied to the motor 185 so that the motor shaft 185*a* rotates with suitable number of revolutions.

In this manner, coating in flow proportional to the number of revolutions of the brush 108 is supplied to the coating roller 102 through the hose 104 from the coating tank 172. That is, if the brush 108 is rotated quickly, a large quantity of coating is supplied to the coating roller 102, and if it is rotated slowly, a small quantity of coating is supplied to the coating roller 102.

Therefore, even if the coating-supply adjusting dial is not operated every time, the flow rate of coating can be adjusted easily, preventing a drip of coating and an occurrence of uneven coated wall. Further, it is not necessary to move eyes for operating the coating-supply adjusting dial, and therefore, an operator is unlikely to get clothes dirty with the coating or take a false step.

On the other hand, when the coating once applied is smoothed, normally, the coating roller 102 is drawn for smoothing. Therefore, the coating once applied is smoothed when the support lever 137 is positioned on the right side R and the brush 108 rotates counterclockwise CCW and when the support lever 137 is positioned on the left side L and the brush 108 rotates clockwise CW, and the output signal is not transmitted to the cord 166.

Therefore, the motor driving voltage and the motor control signal are not produced, and even if the brush 108 is rotated at any speed, the motor 185 is not actuated. Therefore, coating is not supplied to the coating roller 102, and the coated surfaces are easy to be smoothed evenly.

Note, if the coating-supply adjusting dial 212 is operated, a pulse width of the output signal P shown in FIG. 24(B) can be suitably changed. The flow rate of coating can be adjusted according to the outside diameter of the brush 108. If the change-over switch 211 is set to a quantitative supply mode, the coating-supply adjusting dial 212 can be operated as in prior art to adjust the flow rate of coating, performing the coating operation.

Further, note, in the case where a pulse motor is used as a motor, the F-V conversion circuit is not necessary but a pulse waveform can be voltage-amplified to drive the pulse motor.

Figure 25:
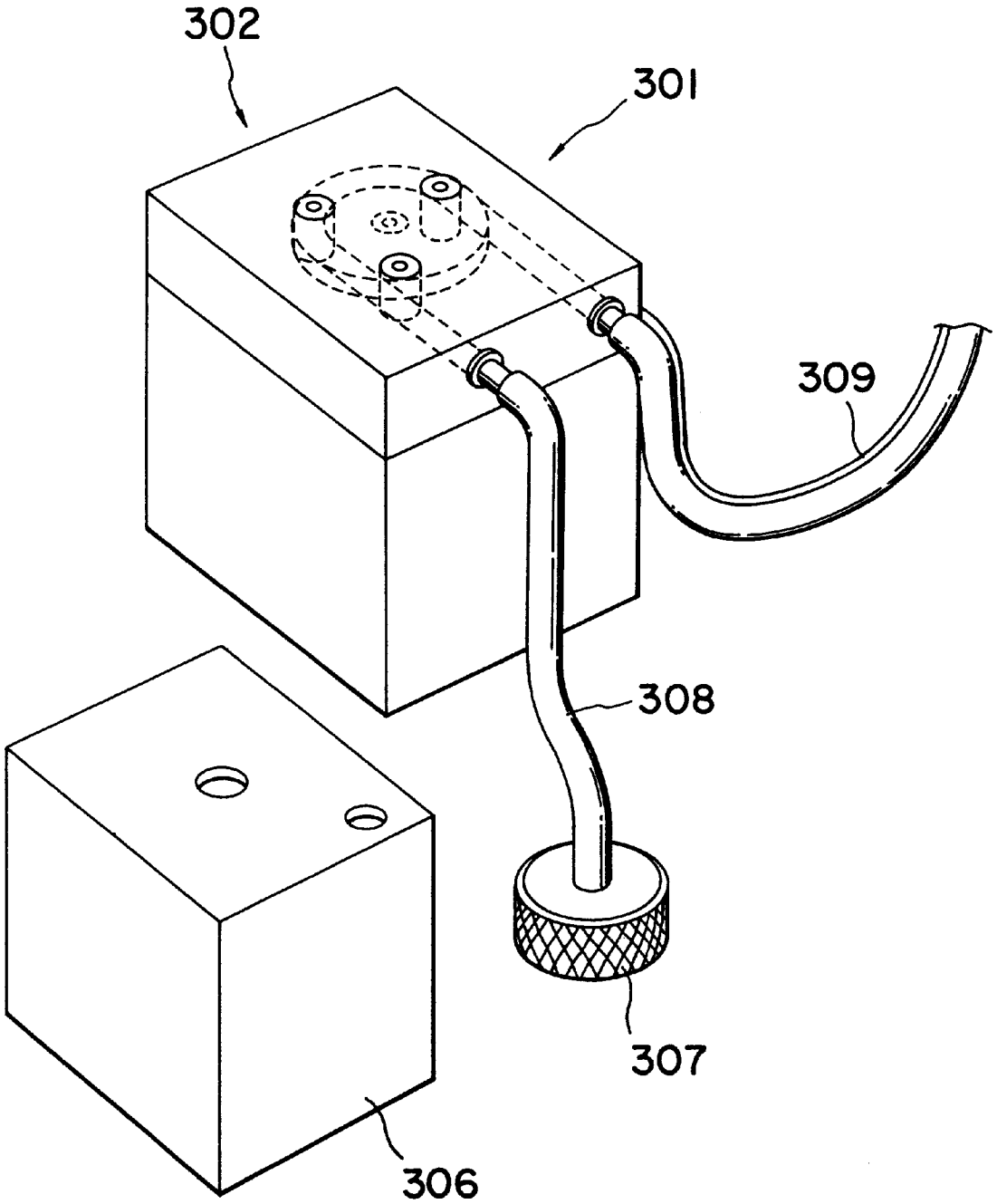
FIG. 25 is a perspective view of a coating supplying apparatus to which a tube pump is applied.

Further, a coating supplying apparatus 301 as shown in FIG. 25 may be used in place of the coating supplying apparatus 103. The coating supplying apparatus 301 applies a tube pump 302 as a coating feed mechanism.

Figure 26:
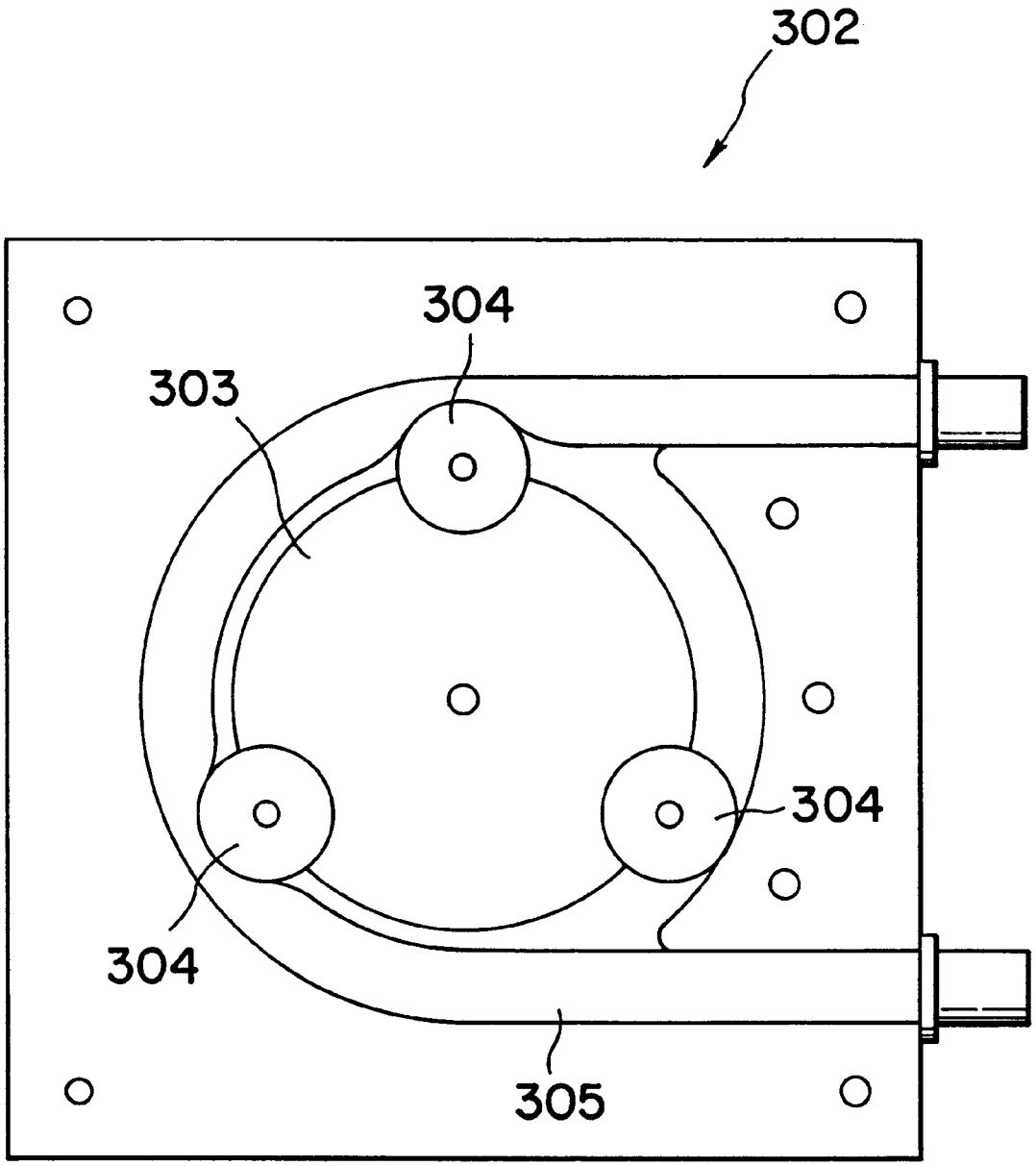
FIG. 26 is a plan view of the tube pump.

The tube pump 302 is configured such that as shown in FIG. 26, a rotor 303 is rotated whereby rollers 304, 304, 304 rotate while compressing a tube 305 to flow the coating within the tube 305 in a rotating direction. The flow rate of coating is changed with the rotational speed of the rotor 303.

According to the coating supplying apparatus 301, a hose 308 having a filter 307 mounted thereon is inserted into a coating tank 306, and the tube pump 302 is driven whereby coating within the coating tank 306 can be fed to a hose 309 through a hose 308 and the tube 305. If one end of the hose 309 is connected to the other end of the support lever 137, coating can be supplied to the brush 108.

The rotor 303 is driven and controlled instead of driving and controlling of the motor 185, whereby the exactly similar function to the above can be realized.

Since the coating supplying apparatus 301 comprises tube pump 302 which is simple in construction of the coating feed mechanism, the entire apparatus can be miniaturized and produced inexpensively.

While the rotation detection element 145, the circuit substrate 162 and the control device 174 have been connected by the cords 147 and 166 to transmit the driving voltage and output signal, it is to be noted that the transmission may be done by wireless.

According to the above, the connecting work of cords is not necessary, and the cords are not obstructed during coating operation, which is preferable.

What is claimed is:

1. coating apparatus comprising:

a coating roller rotatably supported at one end by a support which forms part of a holder, a coating supplying apparatus having:

a coating feed mechanism for discharging a coating material from a coating tank, a control apparatus for controlling operation of the coating feed mechanism, and a hose for connecting the coating roller and the coating supplying apparatus, wherein said control apparatus detects a number of revolutions of the roller and actuates the coating feed mechanism according to the number of revolutions detected so that coating material is supplied to the roller at a coating flow rate corresponding to the number of revolutions of the roller, and further wherein the rotational direction of the roller is discriminated so that when the roller rotates in a predetermined direction, the coating feed mechanism is not actuated and the coating material is not supplied to the roller.

2. The coating apparatus according to claim 1, wherein the position of the support is also discriminated so that when the roller is rotated in a predetermined direction and the support is in a predetermined position, the coating feed mechanism is not actuated and the coating is not supplied to the roller.

3. The coating apparatus according to claim 1, wherein the coating roller comprises:

a core as a shaft of the roller, said core being connected and fixed to the an end of the support, a coating supplying groove extending axially along one side of the core, an axially extending coating flowing hole provided in a proximal end of the core, a connecting and fixing portion is formed in a proximal end of the coating flowing hole, and a coating outflow port communicated with the coating supplying groove, said coating outflow port being provided in one of an intermediate portion and an extreme end of the coating flowing hole.

4. The coating apparatus according to claim 3, further comprising an adjusting plate which is provided with a plurality of axially spaced pores and which is disposed within the coating supplying groove.

5. The coating apparatus according to claim 1, wherein the coating roller comprises:

a core detachably connected and fixed to an end of the support to constitute a shaft of the roller, an elastic member mounted within the core, a stopping projection formed on a roller support portion of the support, an axially extending coating supplying groove formed along one side of the outer peripheral portion of the core, an axial coating flowing hole provided in a proximal end of the core, an inserting groove capable of engaging and guiding the stopping projection provided in a proximal end of the coating flowing hole, a stopping groove provided at an inner end of the inserting groove, and a coating outflow port communicated with the coating supply groove provided in one of an intermediate portion and an extreme end of the coating flowing hole, and wherein when the stopping projection of the support arrives at the stopping groove after passing through the inserting groove, the stopping projection is elastically engaged with the stopping groove by repulsion produced by the elastic member.

6. The coating apparatus according to claim 5, wherein the core is connected and fixed to the end of the support so that the coating supplying groove faces a surface which is being coated.

7. A coating roller comprising:

a support formed with a stopping projection on a roller supporting portion thereof, a core detachably connected to an end of the support to constitute a shaft of the roller, said roller being disposed on said core:

said core comprising:

a core body having:

a coating supplying groove formed axially along one side of said core body, an axially extending coating flowing hole formed in a surface of said core body which is proximal said support, and a coating outflow port which is communicated with the coating supplying groove and which is provided in one of a middle portion and a downstream end of the coating flowing hole, a fitting body inserted in the coating hole having an inserting groove capable of engaging and guiding the stopping projection at the support, said inserting groove being provided in the inner surface and, a stopping groove which is provided at the inner end of the inserting groove, a spring mounted within the coating flowing hole, so that when the stopping projection of the support arrives at the stopping groove after passing through the inserting groove, the stopping projection is elastically engaged with the stopping groove under the influence of repulsion produced by the spring, an adjusting plate provided with a plurality of axially spaced pores, said adjusting plate being disposed within said coating supplying groove, wherein said core further comprises a closing body, the closing body having an inner surface in which stopping groove portions are formed, wherein said core body has an end on which stopping projections are formed, and wherein the adjusting plate is held between said core body and said closing body when the stopping projections of said core body are stopped at the stopping groove portions of said closing body.

* * * * *